US010923267B2

(12) United States Patent
Pichkur

(10) Patent No.: US 10,923,267 B2
(45) Date of Patent: Feb. 16, 2021

(54) TRANSFORMER

(71) Applicants: Yaroslav Andreyevitch Pichkur, Bronx, NY (US); Dmytro Pichkur, Bronx, NY (US)

(72) Inventor: Yaroslav Andreyevitch Pichkur, Bronx, NY (US)

(73) Assignees: Yaroslav A. Pichkur, Bronx, NY (US); Dmytro Pichkur, San Antonio, TX (US)

( * ) Notice: Subject to any disclaimer, the term of this patent is extended or adjusted under 35 U.S.C. 154(b) by 209 days.

(21) Appl. No.: 15/508,915

(22) PCT Filed: Apr. 7, 2015

(86) PCT No.: PCT/US2015/024655

§ 371 (c)(1),
(2) Date: Mar. 4, 2017

(87) PCT Pub. No.: WO2016/036420

PCT Pub. Date: Mar. 10, 2016

(65) Prior Publication Data

US 2017/0207019 A1 Jul. 20, 2017

Related U.S. Application Data

(60) Provisional application No. 62/046,782, filed on Sep. 5, 2014.

(51) Int. Cl.
*H01F 27/08* (2006.01)
*H01F 27/28* (2006.01)
(Continued)

(52) U.S. Cl.
CPC ..... *H01F 27/2823* (2013.01); *H01F 27/08* (2013.01); *H01F 27/24* (2013.01); *H01F 38/14* (2013.01)

(58) Field of Classification Search
CPC ..... H01F 300/14; H01F 27/323; H01F 30/10; H01F 30/12; H01F 38/30; H01F 27/40; H01B 13/025; H01B 17/44
(Continued)

(56) References Cited

U.S. PATENT DOCUMENTS 764,779 A * 7/1904 Stone ..... F16L 9/18 138/115
1,791,719 A 2/1931 Eiseman
(Continued)

FOREIGN PATENT DOCUMENTS

JP 9180550 7/1997
KR 10-2010-0040772 A 4/2011
(Continued)

OTHER PUBLICATIONS

Lee Bee Huat. "Speaker Cables, Single Cables (single)". www.leebeehuat.com/cable_pg35.html. 2005.
(Continued)

*Primary Examiner* — Alexander Talpalatski
*Assistant Examiner* — Joselito S. Baisa
(74) *Attorney, Agent, or Firm* — Tiajoloff & Kelly LLP

(57) ABSTRACT

An electrical transformer comprises a primary circuit extending between two ends. The primary circuit has at least one of the ends thereof connected with a power supply so that a first electrical current from the power source flows through the primary circuit. A secondary circuit is connected with an electrical load. The first and second circuits each have a respective plurality of wire segments having a length and being connected in series. The wire segments are supported so as to extend in pathways adjacent and parallel to each other over the length thereof so that, when viewed in cross section, the wire segments are arranged around a first point with the wires of the primary circuit alternating with the wires of the secondary circuit. The current in the first circuit causes formation of a second electrical current in the secondary circuit that is transmitted to the load.

19 Claims, 26 Drawing Sheets

(51) Int. Cl.
*H01F 27/24* (2006.01)
*H01F 38/14* (2006.01)

(58) Field of Classification Search
USPC ..... 336/60; 174/72 R
See application file for complete search history.

(56) References Cited

U.S. PATENT DOCUMENTS 1,804,478 A 5/1931 Parker
2,057,529 A 10/1936 Karapetoff
2,249,509 A 7/1941 Welch, Jr. et al.
2,522,362 A * 9/1950 Gilbert ..... G01R 31/08 379/22
2,669,603 A 2/1954 Prache
2,932,805 A 4/1960 Doherty
3,137,831 A 6/1964 Foster
3,201,734 A 8/1965 Halacsy
3,229,030 A 1/1966 Baermann
3,238,477 A 3/1966 Brueckmann
3,242,381 A * 3/1966 Davis, Jr. ..... H05B 41/2325 315/187
3,548,071 A * 12/1970 Bahen, Jr. ..... H02G 15/26 174/13
3,577,110 A * 5/1971 Arntz ..... H01F 30/10 336/175
3,675,042 A 7/1972 Merriam
3,694,563 A 9/1972 Monds et al.
3,783,415 A * 1/1974 Koskinen ..... H03H 7/38 333/25
3,902,011 A * 8/1975 Pieters ..... H04N 5/217 348/251
4,017,344 A 4/1977 Loiter et al.
4,086,427 A 4/1978 Nasuta, Jr. et al.
4,117,259 A 9/1978 Giebel et al.
4,312,494 A * 1/1982 Aoyama ..... F01L 9/04 123/90.11
4,346,258 A 8/1982 Kunze
4,486,623 A 12/1984 Ploppa
4,504,813 A 3/1985 Strang
4,538,022 A 8/1985 Barnicol-Ottler et al.
4,665,357 A 5/1987 Herbert
4,692,566 A 9/1987 Kauffman
4,707,671 A 11/1987 Suzuki et al.
4,751,614 A 6/1988 Mehnert
4,777,466 A 10/1988 Bordalen
4,800,236 A 1/1989 Lemke
4,818,820 A 4/1989 LaRock
4,843,356 A 6/1989 Lusignan et al.
4,845,606 A * 7/1989 Herbert ..... G11C 19/085 363/24
4,901,048 A 2/1990 Williamson
4,937,401 A 6/1990 Lee
4,997,992 A 3/1991 Low
5,027,478 A 7/1991 Suhr
5,036,891 A 8/1991 Vogelsang
5,051,034 A 9/1991 Goodman
5,084,594 A 1/1992 Cady et al.
5,148,357 A * 9/1992 Paice ..... H01F 30/12 363/126
5,149,915 A 9/1992 Brunker et al.
5,243,138 A 9/1993 Guthke et al.
RE34,701 E 8/1994 Goodman
5,552,565 A 9/1996 Cartier et al.
5,616,969 A 4/1997 Morava
5,640,314 A 6/1997 Glasband et al.
5,703,330 A 12/1997 Kujawski
5,742,982 A 4/1998 Dodd et al.
5,760,340 A 6/1998 Orr, Jr. et al.
5,999,078 A * 12/1999 Herbert ..... H01F 17/06 336/172
6,027,679 A 2/2000 O'Brien et al.
6,054,914 A 4/2000 Abel et al.
6,087,916 A * 7/2000 Kutkut ..... H01F 27/22 336/195
6,137,392 A 10/2000 Herbert
6,215,062 B1 4/2001 Kimber
6,241,920 B1 6/2001 Cotter et al.
6,353,186 B1 3/2002 Dams et al.
6,365,836 B1 4/2002 Blouin et al.
6,462,462 B2 10/2002 Steinkopff
6,506,971 B1 1/2003 Grach et al.
6,649,842 B1 11/2003 Nishino
6,683,522 B2 * 1/2004 Walsh ..... H01F 17/0006 336/175
6,864,613 B1 * 3/2005 Graham ..... H02K 3/26 310/156.08
6,867,674 B1 3/2005 Schutte et al.
6,870,105 B2 3/2005 Maydanich et al.
6,873,085 B2 * 3/2005 Graham ..... H02K 1/27 310/156.08
6,969,807 B1 11/2005 Lin et al.
7,009,105 B2 3/2006 Chou
7,023,317 B1 * 4/2006 Herbert ..... H01F 27/306 336/175
7,119,648 B1 10/2006 Herbert
7,126,055 B1 10/2006 Low et al.
7,135,952 B2 11/2006 Harding
7,158,003 B2 * 1/2007 Cern ..... H01F 19/08 336/175
7,202,416 B2 4/2007 Komuro et al.
7,362,206 B1 * 4/2008 Herbert ..... H01F 29/02 336/220
7,443,278 B2 10/2008 Kawahata et al.
7,633,014 B2 12/2009 Allais et al.
7,709,741 B2 5/2010 Reichert et al.
7,772,495 B2 8/2010 Wu et al.
7,864,013 B2 1/2011 Muelleman
7,915,992 B2 3/2011 de Rooij et al.
7,923,642 B2 4/2011 Corso
7,964,797 B2 6/2011 Clark et al.
7,973,614 B2 7/2011 Taracila et al.
8,120,546 B2 2/2012 Smith et al.
8,155,491 B2 4/2012 Lapp
8,310,327 B2 11/2012 Willers et al.
8,350,659 B2 1/2013 Dziubek et al.
8,436,703 B2 5/2013 Lee
8,471,663 B2 6/2013 Cho et al.
8,586,868 B2 11/2013 Liu et al.
8,987,601 B2 * 3/2015 Shiga ..... B60R 16/0215 174/135
9,159,487 B2 * 10/2015 Peck ..... H01F 41/02
9,450,389 B2 9/2016 Pichkur et al.
9,947,450 B1 * 4/2018 Peck, Jr. ..... H01F 27/24
10,403,429 B2 * 9/2019 Peck, Jr. ..... H01F 41/02
10,504,647 B2 * 12/2019 Renteria ..... H01F 27/29
10,839,986 B2 * 11/2020 Menger ..... H01B 7/40
2005/0077067 A1 4/2005 Chou
2005/0247472 A1 * 11/2005 Helfer ..... A61N 1/16 174/36
2008/0179969 A1 7/2008 Dooley et al.
2009/0205866 A1 * 8/2009 Bremnes ..... H02G 7/20 174/99 R
2009/0273538 A1 11/2009 Smith et al.
2011/0090035 A1 4/2011 Kikuchi et al.
2011/0240341 A1 * 10/2011 Lipiansky ..... H02G 3/03 174/135
2014/0159845 A1 6/2014 Barbat
2014/0251684 A1 9/2014 Pichkur et al.
2015/0028986 A1 1/2015 Barry et al.
2016/0020001 A1 1/2016 Pichkur et al.

FOREIGN PATENT DOCUMENTS

WO 89/10621 A1 2/1989
WO 2014/006622 A1 1/2014
WO 2014/137873 A1 9/2014

OTHER PUBLICATIONS

New World Encyclopedia. "Dipole". http://www.newworldencyclopedia.org/entry/Dipole. Page last modified on Oct. 1, 2008.

(56) References Cited

OTHER PUBLICATIONS

Fiolhais, M.C.N. "Magnetic Field and Current are Zero Inside Ideal Conductors". "Progress in Electromagnetics Research B". vol. 27, pp. 187-212, 2011.
Wikipedia. "Balanced Line". http://en.wikipedia.org/wiki/Balanced_line. Mar. 20, 2012.
Wikipedia. "Quadripole Magnet". http://en.wikipedia.org/wiki/Quadripole_magnet. Retrieved Apr. 1, 2012.
Wikipedia. "Inductive Coupling". http://en.wikipedia.org/wiki/Inductive_coupling. Aug. 14, 2012.
Wikipedia. "Perfect Conductor". http://en.wikipedia.org/wiki/Perfect_conductor. Mar. 20, 2012.
Wikipedia. "Metamaterial Cloaking". http://en.wikipedia.org/wiki/Metamaterial_cloaking. Dec. 14, 2012.
Espacenet. English language abstract of JP 9180550, Sasagawa et al. Jul. 11, 1997.

* cited by examiner 403
405
403
405
403
405
405
403
405
403
405
403
405
403
401
405
403
405
403
405
403
405
403

TRANSFORMER

RELATED APPLICATIONS

This application claims the benefit of U.S. provisional patent application Ser. No. 62/046,782, filed Sep. 5, 2014.

FIELD OF THE INVENTION

This invention relates to the field of transformers that convert an incoming current to an outgoing current, and especially where the incoming and outgoing currents have different voltages.

BACKGROUND OF THE INVENTION

A typical electrical transformer utilizes inductive coupling between two separate but adjacent primary and secondary coils of wire. Current flowing through the wire of one coil (the primary coil) induces a current in the wire of the other coil (the secondary coil).

One of the most common configurations of a transformer is the coaxial transformer. In a coaxial transformer, the primary and secondary coils usually are each a tubular stack of many loops with a cylindrical center passage, with the secondary coil supported inside the primary coil so that both coils have the same longitudinal axis. When AC current is applied to the primary coil, it creates a fluctuating magnetic field flowing through the center, and also around the outside of the primary coil. The fluctuating magnetic field passes through the center of the loops of the secondary coil, and this creates a corresponding AC current in the secondary coil.

The current in the secondary coil usually has a voltage that differs from the input voltage of the primary coil by a ratio that corresponds to the ratio of the total area of all the loops of the secondary coil to the total area of all the loops of the primary coil.

An ideal transformer would convert 100 percent of the power applied to the primary coil to the current in the secondary coil, but in practice transformers are much less efficient. Conventional transformers lose power by the extension of the magnetic field of the primary coil away from the secondary coil, or by other areas of loss, e.g., by the formation of currents in the magnetic core of the transformer.

Some efforts have been made to reduce these losses, e.g., providing shielding or lamination surrounding the coils, but such arrangements continue to lose power, and may also create waste heat, with the result that transformers may require complicated systems of cooling elements to avoid overheating.

SUMMARY OF THE INVENTION

It is accordingly an object of the present invention to provide a transformer that overcomes one or more of the drawbacks the prior art.

According to an aspect of the invention, an electrical transformer comprises a primary circuit extending between two ends. The primary circuit has at least one of the ends thereof connected with a power supply so that a first electrical current from the power source flows through the primary circuit. A secondary circuit is connected with an electrical load. The first and second circuits each have a respective plurality of wire segments having a length and being connected in series. The wire segments are supported so as to extend in pathways adjacent and parallel to each other over the length thereof so that, when viewed in cross section, the wire segments are arranged around a first point with the wires of the primary circuit alternating with the wires of the secondary circuit. The current in the first circuit causes formation of a second electrical current in the secondary circuit that is transmitted to the load.

Other objects and advantages of the invention will become apparent from the specification herein, and the scope of the invention will be set out in the claims.

DETAILED DESCRIPTION

As has been mentioned, the transformers of the prior art are typically made up of two discrete sets of multiple loops arranged coaxially, often with one entire circuit of loops radially inside the other, with the magnetic field flux occurring essentially in the center of the loops. In contrast, the present invention generally makes use of the exchange of magnetic flux between adjacent generally parallel wires or bundles of wires extending through supportive structures that hold the wires in parallel configuration with each other. In the parallel arrangement, the wires or wire bundles of the wires being supplied with power (the primary circuit) are distributed rotatively-spaced around the lengthwise axis of the wires or wire bundles receiving the magnetic flux and generating the output current (the secondary circuit). The result is a more efficient magnetic-flux interaction of the respective wires or wire bundles.

Figure 1:
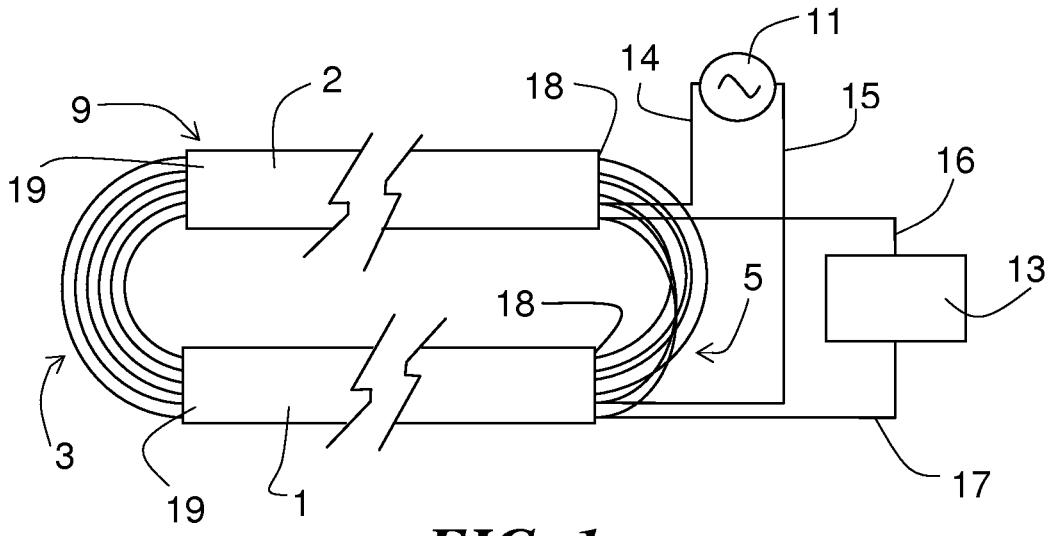
FIG. 1 is a schematic diagram of an embodiment of power transformer according to the invention.

The general arrangement of a transformer according to the invention is illustrated in the embodiment of FIG. 1. An electrical power transformer system generally indicated at 9 connects an AC power source 11 to load 13. The AC power source may be any power source desired, such as, for example, standard American 120-volt 60-Hz AC house current. The load 13 may be any type of electrical load or device, e.g., a motor, a lamp, or any sort of electrical device or converter.

The power source 11 transmits a current in wire segment 14, which carries the electrical current to the transformer system generally indicated at 9, the current returns to the other pole of the power source 11 via wire segment 15. Between the input and output wire segments 14 and 15, the current is routed through a primary transformer circuit formed of wiring in wire support structures 1 and 2, and connecting wires generally indicated at 3 and 5, as will be described below. Wire segments 16 and 17 connect load 13 with a secondary circuit also formed by the wiring in the support structures 1 and 2 and the connecting wires 3 and 5. Electrical current is generated in the secondary circuit responsive to passage of the current through the primary circuit from the power source 11, and the electrical current generated in the secondary circuit is supplied to the load 13 via wire segments 16 and 17.

Figure 2:
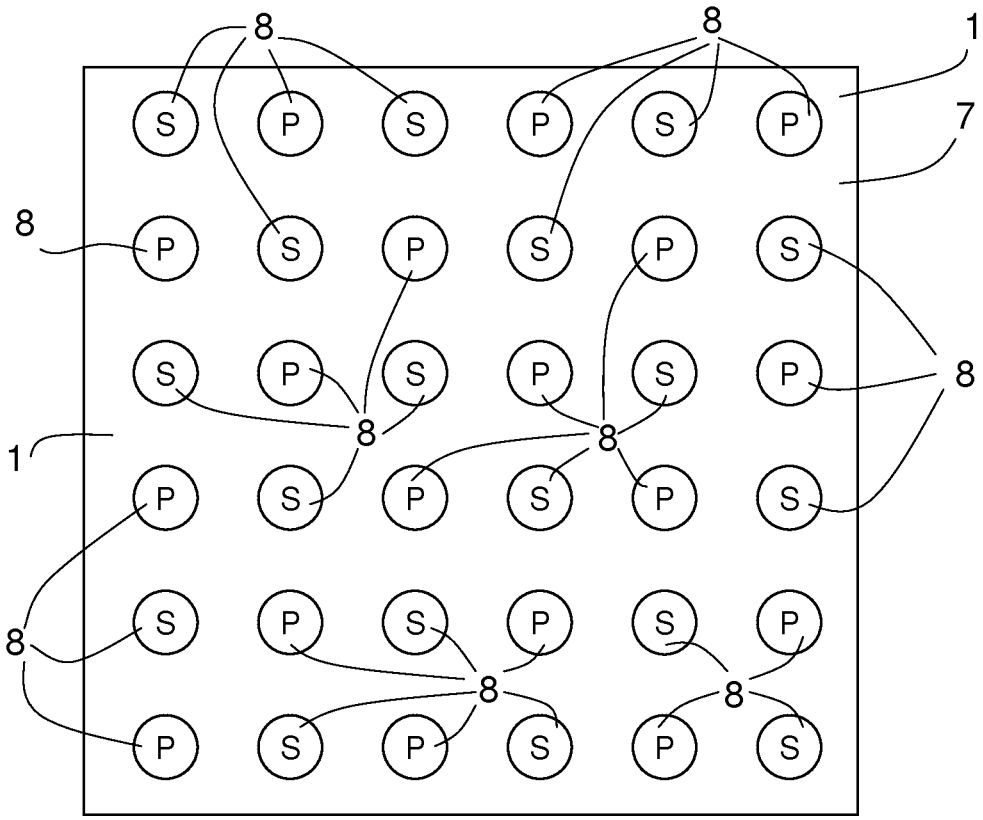
FIG. 2 is a diagram of the cross section of a support structure of the transformer of FIG. 1.

Referring to FIG. 2, wire support structures 1 support the wires of the primary and secondary circuits to extend in parallel through the length of the support structure, with the wires being in the same relative positions over its length. The arrangement of the wires in the support structures is such that the current in the primary circuit efficiently produces the current in the secondary circuit, making optimal use of the magnetic fields produced around the wires of the primary circuit.

The body 7 of the support structure is shown generally in schematic form. One of the primary functions of the body 7 is to support the wires 8 in their same relative positions to each other over the length thereof.

In addition, in the transformer of the invention, it is preferable that the inductance between the primary and secondary circuits is enhanced by the use of magnetic core materials in the support structure body 7 between the wire segments of the primary and secondary coils. To achieve this, the body 7 may be formed of an electrically-insulating material of high magnetic permeability, such as high-density polyethylene (HDPE), PVC, or some other insulating plastic material mixed with some sort of iron-containing or other magnetic metal-containing particles, granules or powder, such that the plastic structure has magnetic qualities that intensify the magnetic fields and inductance between the wires passing through it. The body 7 may also be made of other materials, such as non-conductive ferritic materials in a structure encasing the primary and secondary circuits, as will be set out herein, or the body 7 may be a structure formed of a large number of mutually insulated iron-containing elements forming a lattice structure around the wires, such as any of the matrix wire-supporting structures shown in FIGS. 11 to 16 or 20 to 21.

The pattern of the positions of the wires of the primary and secondary circuits may be one of several possible arrangements. The general principle of the arrangement is that, for at least some of the wires of the primary circuit in the support structures 1, 2, e.g., in the interior of the body 7, each wire has a number of wires of the secondary circuit grouped around it, rotatively distributed around an axis of the primary circuit wire. Preferably, the number of wires is three or more, and the distribution of the secondary circuit wires is by successive equal angular rotations, e.g., 90 degrees or 120 degrees.

FIG. 2 shows one possible cross-section of the organization of the wires 8 in wire support structure 1. The cross-sectional pattern is taken through the support structure 1 perpendicularly to the wires 8. The cross section of support structure 2 is a mirror-image of support structure 1, in terms of the positions of the primary and secondary wires. The cross-sectional patterns are substantially constant over the length of the structures 1 and 2.

The body 7 supports the wires in a square 6×6 matrix pattern in the embodiment shown. Wires of the primary circuit of the transformer system are indicated by reference characters "P" and the wires 8 of the secondary circuit are indicated by reference characters "S". The primary circuit wires P and the secondary circuit wires S alternate with each other in both the horizontal rows and the vertical columns of the cross-section matrix. The wires 8 are each at least 0.10 inch from the adjacent wires 8 in the row or column.

Support structures 1 and 2 are physically the same, and the wires 8 are identical, and may be any conductor, insulated wire, twisted conductive wires, or a number of independently insulated bundles of wires as will be described below. The positions of the primary and secondary circuit wires are a consequence of the specific locations of the connections of the connective wires 3 and 5 between the support structures 1 and 2, and the placement of the connection of wires 14, 15, 16 and 17 to individual wires 8 in the support structures.

Figure 3:
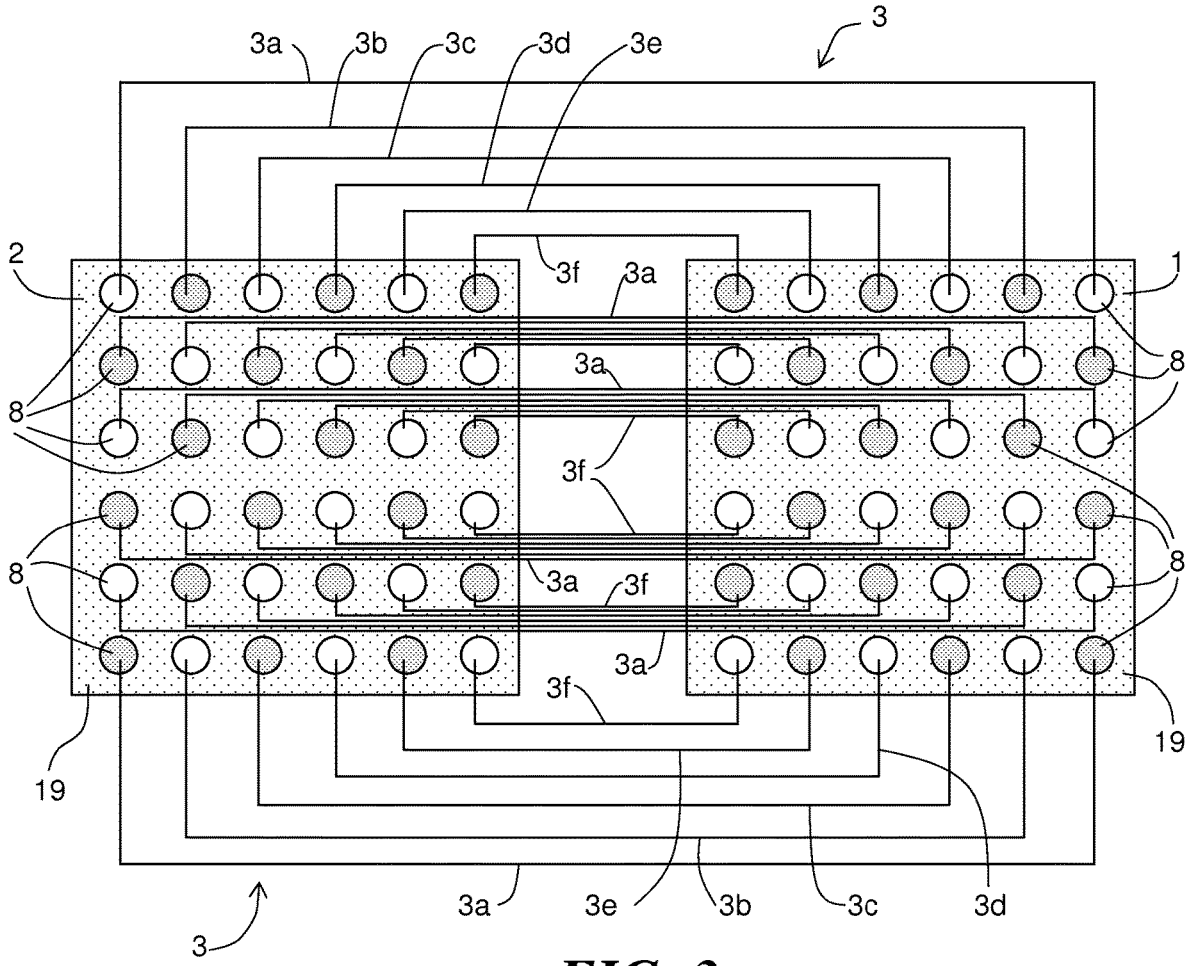
FIG. 3 is a schematic diagram of the connections of the wiring of a side of the transformer of FIG. 1.

FIG. 3 shows in the wiring pattern of the set of connecting wires 3 that extend between the rear faces 19 of the support structures 1 and 2. The wires 8 are shown as circles, with darker circles indicating the wires 8 of the primary circuit, and light circles the wires 8 of the secondary circuit.

The wires 3 are each insulated, and each connects a respective end of a wire 8 in support structure 1 with a respective end of a wire 8 in support structure 2. The set of wires 3 comprises a set of six wires 3*a*, 3*b*, 3*c*, 3*d*, 3*e* and 3*f* for each row of wires 8 in the matrix pattern of the structures 1 and 2. In each row, wire 3*a* electrically connects the laterally innermost wires 8 in structures 1 and 2. Wires 3*b* electrically connect the next outward wires 8 in the row, as do wires 3*c*, 3*d* and 3*e*. The laterally outermost wires 8 are electrically connected to each other by wires 3*f*. Essentially, the connections are laterally symmetrical across the two matrices.

Figure 4:
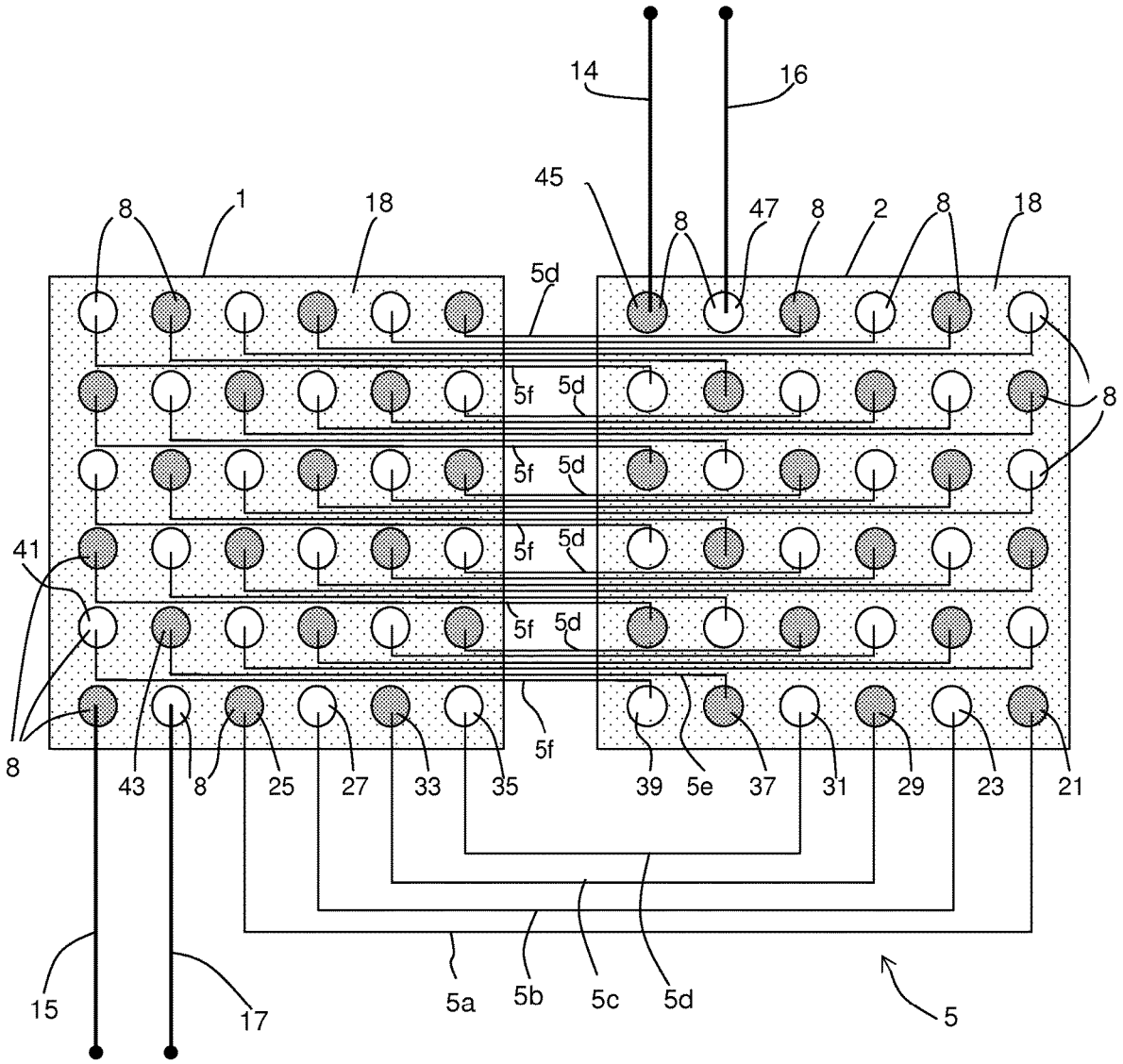
FIG. 4 is a schematic diagram of the wiring of the other side of the transformer shown in FIG. 3.

FIG. 4 is a schematic of the front ends of a pair of support structures 1 and 2, and shows the wiring the set of connecting wires 5 of front faces 18 of the support structures 1 and 2. These connections create a group of circuits in the transformer system 9 that constitute the primary and secondary circuits. Eighteen loops are formed in the primary circuit, and another eighteen loops are formed in the secondary circuit. The darker colored circles correspond to the primary winding circuit, and the white circles correspond to the secondary circuit. The two winding circuits are not in electrical contact, but a current in one magnetically induces a current in the other. Both the primary and secondary winding circuits form loops around the center of the transformer 9.

Wires 5 are electrically insulated, and each wire 5 electrically connects an end of a respective wire 8 in structure 1 to an end of a respective wire 8 in structure 2. AC power line 15 is connected to the first wire in the bottom row of the matrix of wires in front face 18 of support structure 1. Load connecting wire 17 is connected with the second wire 8 in the bottom row of the matrix of wires in structure 1. The other AC power line 14 is electrically connected with the first wire 8 in the top row of the matrix of wires 8 in support structure 2. The other load connecting wire 16 is electrically connected with the second wire 8 in that row.

Current entering support structure 1 at wire 15 flows through the bottom left wire 8 of structure 1 to opposite end 19 of structure 1. It there is connected by one of wire set 3 with the distal end of the last wire in the bottom row of wires 8 in structure 2. The current then flows through that wire 8 to its proximal end 21 in the front end 18 of structure 2.

Lead line 17 electrically connects with the second wire 8 of the bottom row of structure 1. That wire 8 extends through to the distal end of the structure 1 where one wire of connecting wire set 3 connects it with the next-to-last wire 8 in the bottom row of wires in structure 2, which extends through to a proximal end 23 thereof in the front end 18 of structure 2.

Wire end 21 is connected via end wire 5*a* to the third wire 25 of the bottom row of structure 1, i.e., with a shift two wires to the right. This forms the first loop of the primary circuit. Wire end 23 is connected by end wire 5*b* to the fourth wire end 27 in the bottom row of structure 1, forming the first loop of the secondary circuit.

Wire end 25 connects through structure 1, the respective end wire 3, and then through structure 2 with the front end 29 of the third from the last wire in the bottom row of wires 8 in structure 2. Wire end 27 connects through the structures 1 and 2 via the associated end wire 3 to wire end 31. Wire ends 29 and 31 connect by end wires 5*c* and 5*d* respectively with wires 8 shifted two wires to the right, i.e., with wire ends 33 and 35 respectively, completing the second loops of the primary and secondary circuits.

The third loops of the primary and secondary circuits are formed by the wires 8 from ends 33 and 35 extending through structure 1, relevant end wires 3 and back through proximal wire ends 37 and 39. The proximal ends 37 and 39 are connected via front end wires 5*e* and 5*f* to the first two wires 43 and 41, respectively, forming the loops.

The wiring 3 and 5 at this point essentially repeats the pattern for the bottom rows of the structures 1 and 2 for all rows of wires, until the first two wires 45 and 47 of the top row of structure 2, which, instead of being connected with wires 5*e* and 5*f* linking up to the next row, they connect with lines 14 and 16.

The wire segments of the primary and secondary circuits in the cross sections of the support structures alternate with each other in both horizontal and vertical directions. In this embodiment, eighteen loops are formed in the primary winding circuit, and another eighteen loops are formed in the secondary winding circuit. The two winding circuits are not in electrical contact, but a current in one magnetically induces a current in the other.

Figure 5:
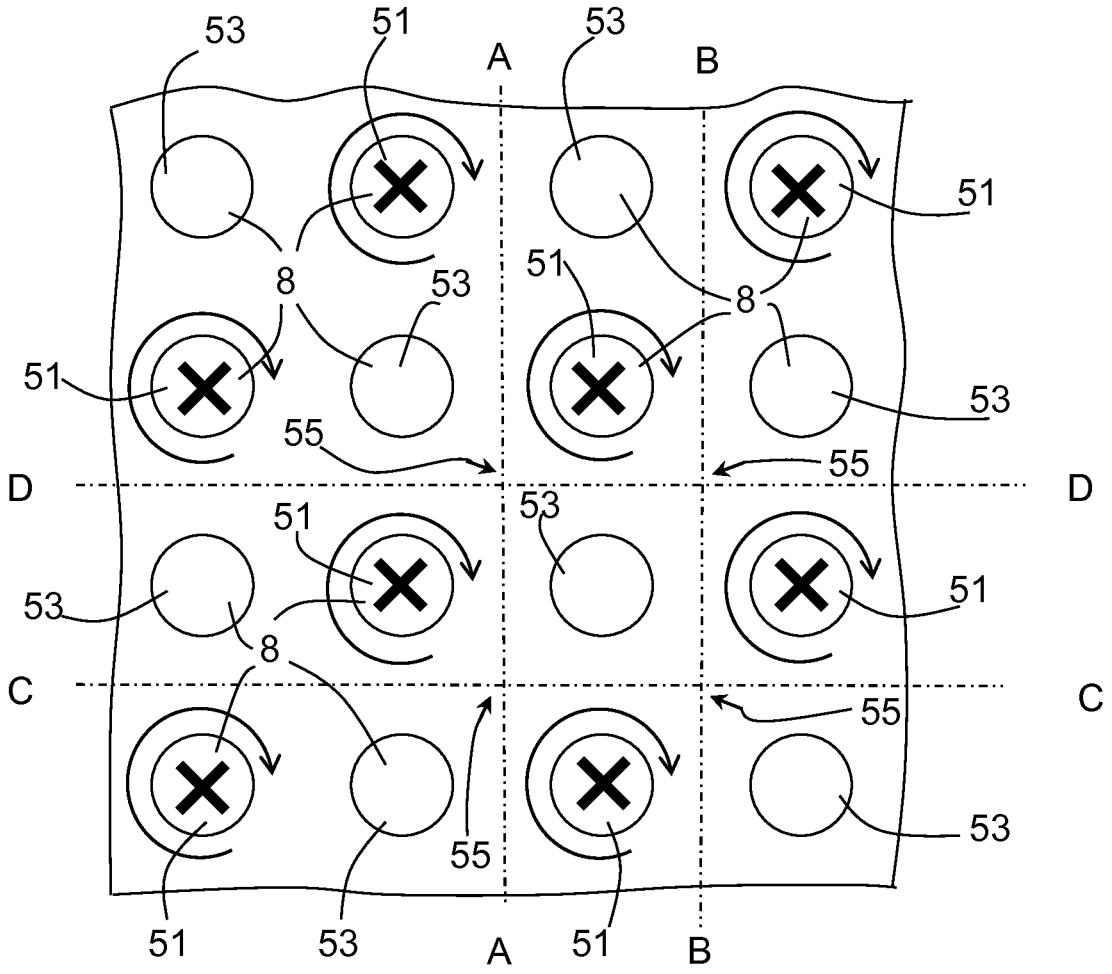
FIG. 5 is a detail diagram of the cross-section of the transformer of FIG. 1 showing the magnetic fields created around some of the wires of the primary circuit.

FIG. 5 is a detailed diagram of a cross section of the wires in the support structures 1 and 2. In the diagram, wires 51 are wires 8 of the primary circuit. The wires 53 are wires 8 of the secondary circuit. Lines AA and BB are the vertical centerlines between the columns of wires 8, and lines CC and DD are the horizontal centerlines between the rows. These vertical and horizontal centerlines intersect at intersection points 55. The material of the support structure between the wires 8 and along lines AA, BB, CC, and DD is magnetically permeable material. Arrows 57 around the wire segments 51 indicate the orientation of the magnetic field created in the primary circuit by current passing through it, with the current direction going into the page of the diagram.

Points 55 indicate central points or junctures that are each between respective groups of four wires 8, i.e., two primary circuit wires 51 and two secondary circuit wires 53. The wiring of the primary and secondary circuits is such that, proceeding circularly around a central point 55, the wires 8 alternate between wires 51 of the primary circuit 51 and wires 53 of the secondary circuit 53, and each primary-circuit wire 51 in the support structure is surrounded by four secondary-circuit wires 53, except for the wires 51 on the outer surface of the support structure. The result is that there is an efficient transmission of magnetic energy between the primary and secondary circuits.

Generally, for the wires interior to the support structures 18, each wire 8 of the primary circuit extends through the support structure 18 with four wires of the secondary circuit extending adjacent and parallel to, rotatively displaced equally around the primary circuit wire at equal relative angles of 90 degrees. Similarly, internal wires of the secondary circuit extend through the support structure 18 with four wires of the primary circuit extending adjacent and parallel to it, rotatively displaced around the secondary circuit wire at equal relative rotative angles of 90 degrees. The wires of the circuits on the outer surface are adjacent to two or three wires of the other circuit, depending on whether the wire is at the corner of the matrix or on its edge, with the two or three opposite circuit wires 8 being rotatively staggered about the axis of the wire by equal angular displacements of 90 degrees, as well.

It will be understood that although the embodiment shown in FIGS. 1 to 5 has support structures 1 and 2 that are each a 6×6 square matrix pattern, the cross-sectional matrix pattern of wires may be larger or smaller and still obtain advantages of the invention. The matrix also need not be square. Matrix patterns of wires may be virtually any size of rectangular or square matrix, e.g., 4×8, 100×100, 500×70, or a matrix with any number of rows and columns.

The functionality of the transformer derives from the support structure holding secondary wires surrounding each of the primary wires over the length of the respective structure so as to efficiently transfer energy between the primary circuit wire and the secondary circuit wires surrounding it. The specific sequential spiraling order of the connections of the primary and secondary circuit wires described above, i.e., the circuit connections spiraling outward through the row, then up to the innermost connection of the circuit in the next higher row, and then outward through that row, is not necessary to obtain an advantageous operation of the transformer of the invention. For example, alternatively, the wires of each circuit may be connected with the wire ends of the support structures in a different progression pattern, or even by randomly connecting ends of wires in one end of a structure with the ends of the other wires in the other structure, provided the alternating pattern of primary and secondary circuit wires is maintained.

To put this more specifically, with reference to FIG. 2, in an alternative wiring order, the ends of each of the wires S of the secondary circuit may be connected with a respective randomly selected end of the secondary-circuit wires S in the other support structure, and the primary circuit wire ends P each connected with the ends of the primary circuit wires P of the other support structure, so that all the wires 8 indicated in dark circles in FIGS. 3 and 4 carry the current through the support structures 18, and the wires 8 indicated by light-colored circles are wired in series so as to produce a current from the varying magnetic field created by the primary circuit. The arrangement of alternating primary and secondary circuit wires remains the same as in the embodiment described above; only the sequence of their connection within the respective circuit would be varied.

Figure 6:
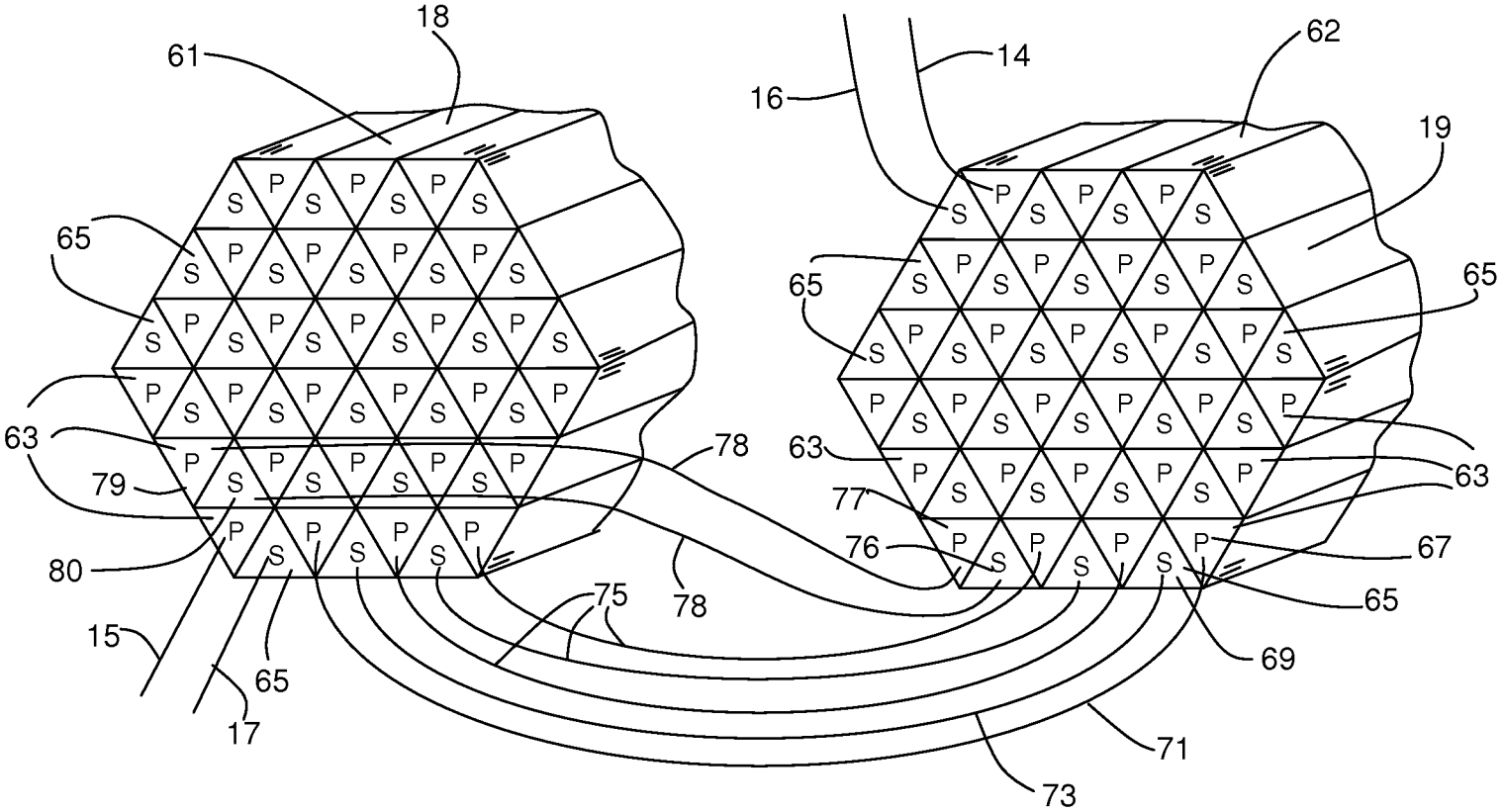
FIG. 6 is a diagram of a cross sectional view of an alternate embodiment of the invention, in which the wires of the primary and secondary circuits are in a hexagonal cross-sectional pattern.

FIG. 6 is a schematic diagram of the wire arrangement of an alternate embodiment of support structures 61 and 62 that may be used in support structures 1 and 2 of FIG. 1, and the same reference numbers are used for equivalent parts.

Instead of a square-shaped matrix cross-section with rectilinear coordinates, the embodiment of FIG. 6 has a generally hexagonal shape. The support structures 61 and 62 are made up of insulated wires indicated as P or S, some of which are identified by reference characters 63 or 65. The wires are shown as members with a triangular cross-section in FIG. 6, extending in parallel over the length of the structures 61 and 62. Each wire is preferably a core of conductor surrounded by a sheath of insulating magnetically-permeable material. The sheath need not be triangular, but the geometrical organization of the substantially parallel wires that are supported in the sheaths is important. The wires marked "P" form the primary circuit, and wires labeled "S" make up the secondary circuit.

The wiring of the front faces of the structures 61 and 62 is shown in FIG. 6. As in the previous embodiment, wires 14 and 15 connect to the power source 11, and wires 16 and 17 connect to the load 13. Wire 15 is electrically connected to the first wire 63 of the primary circuit P in the bottom row of wires in structure 61. Wire 17 is connected with the second wire 65 of the secondary circuit S in the bottom row of wires in structure 61.

Wire 63 carries the current from line 15 to the opposing end of the structure (not shown) where the distal ends of all the wires in the structure are connected similarly to the end connection 3 of FIG. 3. The first wire 63 is connected by a wire to the last wire 67 of the bottom row of structure 62. The wire 65 connected with line 17 extends to a distal end wherein the end connecting structure 3 as in FIG. 1 connects with its minor image position in the cross-sectional wire pattern of structure 62, i.e., the next-to-last wire 69 of the bottom row of wires of structure 62.

To form the first loop of the primary circuit, front loop 71 connects wire 67 to the third wire 65 of the bottom row, returning back shifted two wires to the right in the row. Progressing horizontally across the row, the second wire from the end of the bottom row of structure 62 forms the first secondary circuit loop by electrical connection via wire 73 to the fourth wire in the bottom row of structure 61.

The primary and secondary circuits form subsequent loops by extending through the structure 61 then across to the mirror-image position wire in structure 62, and then by front loop connection wires 75 to wires shifted over two wires to the right in the row. Finally for the bottom row, the leftmost two wires 76 and 77 of the bottom row of structure 62 connect via row-shifting connecting wires 78 to the first two wires 79, 80 of the next-to-bottom row of structure 61.

This pattern is repeated for all the rows, i.e., mirror-image connections of the distal ends and shift right two wires for all connections in the front row, except the leftmost two wires of the rows of structure 62, which connect with the leftmost wires of the next row up in structure 61. That pattern continues up to the leftmost two wires of the top row of structure 62, which connect to the lines 14 and 16 to the AC power and the load.

It will be understood that the wires P and S are illustrated schematically in FIG. 6 as triangles, but they may take a variety of forms, e.g., a central circular cross section wire embedded in a triangular shaped insulation-material body, or a typical circular cross section braided wire surrounded by a generally tubular sleeve of insulation, or almost any other configuration of conductor known in the art. The primary concern is that the conductor portion of the wires P and S should be supported over the length of the carrier in the central position in the triangular volumes shown in FIG. 6 and labeled P or S. Also, they may be a bundle of mutually insulated wires extending together in the space in the bodies 18 or 19.

Figure 7:
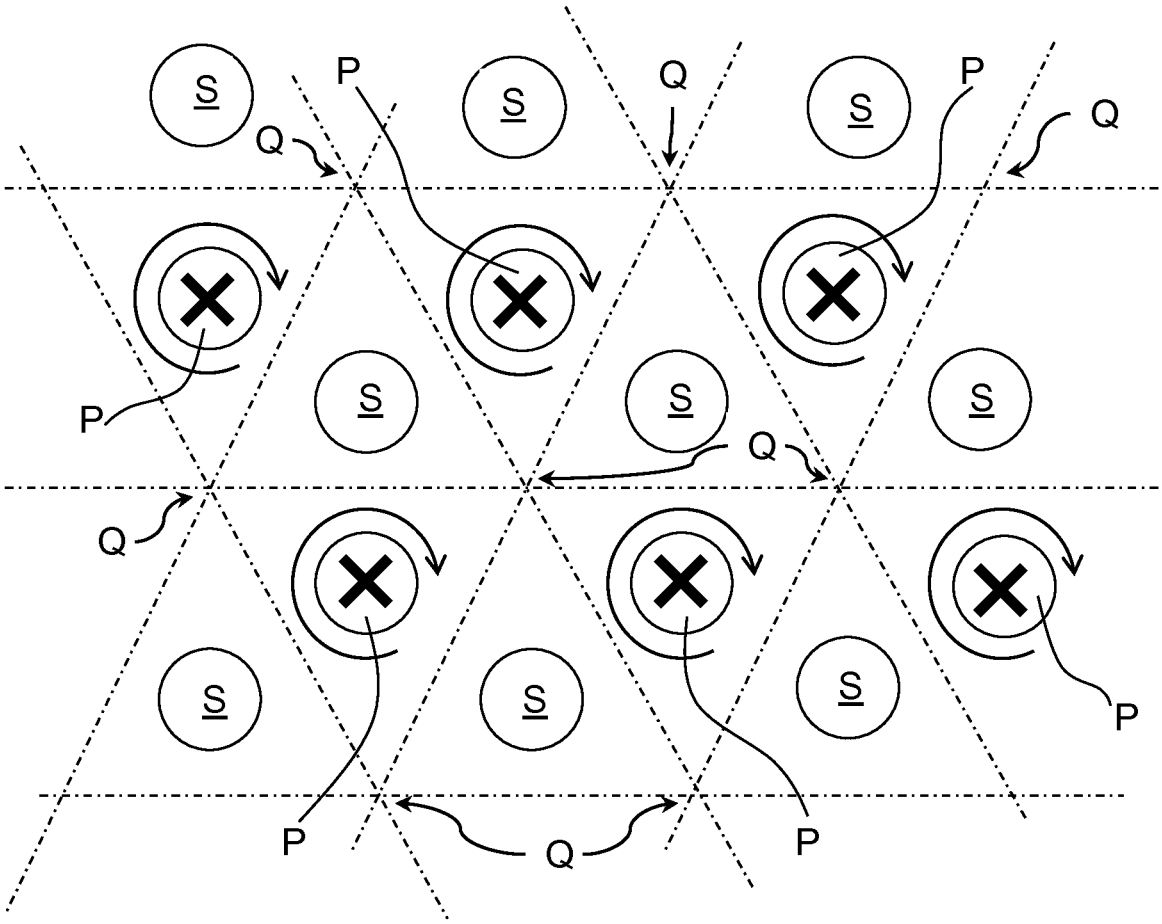
FIG. 7 is a detail of the cross section diagram of the embodiment of FIG. 6.

FIG. 7 shows a more detailed view of a cross-section of the structures 61 and 62. Throughout the structure, wires P belonging to the primary circuit and wires S belonging to the secondary circuit are grouped so that three wires P and three wires S surround each central point Q in the structure. The wires P and S are substantially equidistant from the center points Q, and they alternate circularly around central points Q with an angular spacing of approximately 60 degrees between adjacent wires.

Each of the wires P or S forms part of three groups around three different central points Q, except for the wires P and S that are on the outer surface of the carrier 61. As a corollary, almost all of the wires P, i.e., those that are interior to the carrier, are surrounded by three parallel wires S, rotatively spaced at 120 degrees from each other about the central axis of the wire P. When current flows through the wires P, which in FIG. 7 is indicated as flowing in the direction into the surface of the diagram, the resulting magnetic field has a primary effect on the three surrounding parallel wires S, inducing a reactive current therein. Expressed somewhat differently, each wire S is acted upon primarily by the magnetic fields of three surrounding wires P that are rotatively staggered at equal angles about wire S, i.e., at 120 degrees relative to each other.

Expressed somewhat differently, each wire P in the interior of the wire support structures of FIGS. 6 and 7 has three wires nearest adjacent it by which it is surrounded, and these wires are three secondary circuit wires S spaced rotatively at 120 degrees relative to each other. The wires P on the outer surface of the wire support structures 61 and 62 have only two immediately neighboring wires, but they are also wires S of the secondary circuit as well.

In addition to the progressive pattern of circuit connections described above, it is also possible to derive a benefit of the invention where the ends of the S wires on the support structures are connected in a different order or pattern, or even a random pattern, wherein each end of a wire S in support structure 18 connects with a respective end of a wire S in support structure 19. The main consideration is that each wire P in the interior of the support structure is surrounded by three immediate neighboring wires S of the secondary circuit.

Figure 8:
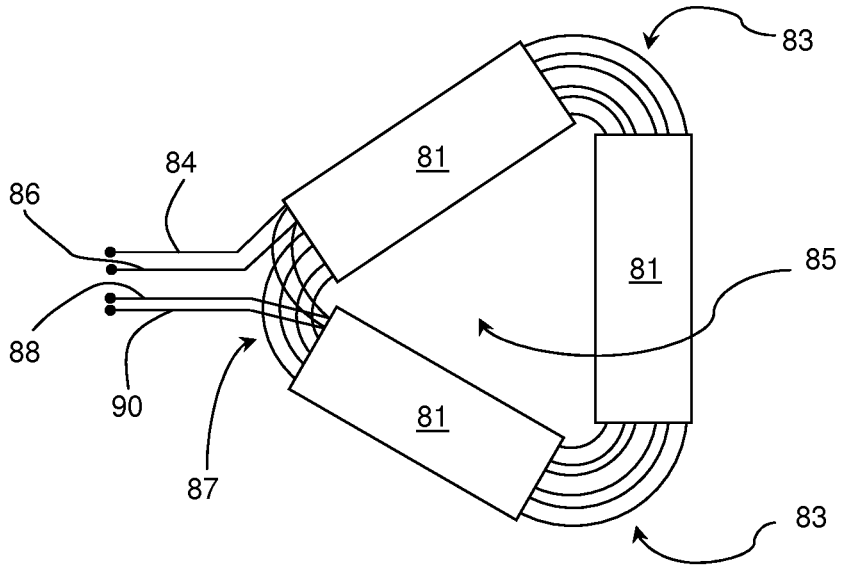
FIG. 8 is a schematic diagram of another alternate embodiment of the invention, wherein the circuits of the transformer are supported in three wire-supporting structures.

FIG. 8 shows a schematic of an alternate embodiment having three support structures 81 similar to the 6×6 square matrix support structures 1 and 2 shown in FIG. 1. Alternatively, structures such as shown in FIG. 6 may be employed. The primary circuit connects to a power source via leads or wire segments 84 and 88. The secondary winding circuit connects to a load via wire segments 86 and 90. Support structures 81 hold the wires in parallel in a cross-sectional 6×6 matrix pattern (or in a square or rectangular matrix or hexagonal packing pattern of any number of wires), and electrically insulate the wires from each other, so that the primary circuit is electrically insulated from the secondary circuit. Connector arrangements 83 of wire segments connect the wires of the support structures 81, and are essentially the same as the wiring shown in FIG. 3, i.e., with a one-to-one mapping of the ends of wires to the same wire location in the next structure 81. Connector arrangement 87 of wires connect the wires of the front ends 82 of support structures 81, with a shift two wires to the right at each iteration so as to form the circuits. The wiring pattern of connection arrangement 87 is preferably the same as that shown in FIG. 4, but may be any pattern that connects all of the ends of the circuits so that the circuit wires extend through the carriers 81 in the alternating pattern shown in e.g., FIG. 2. A central space 85 is defined by support structures 81 and is characterized by the absence of a central core, in contrast with conventional coaxial transformers.

Figure 9:
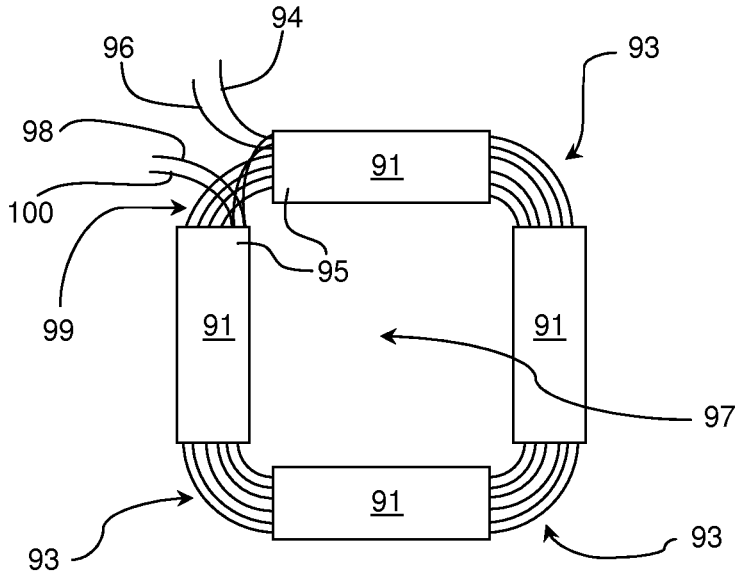
FIG. 9 is a schematic diagram of still another alternate embodiment of the invention, wherein the circuits of the transformer are supported in four wire-supporting structures.

FIG. 9 shows a schematic of another embodiment of the invention having four support structures 91 that are 6×6 matrix or other matrix or hexagonal pattern structures similar to those of FIG. 1. The primary circuit connects to a power source via wire leads or segments 94 and 98. The secondary circuit connects to a load via wire leads or segments 96 and 100. Support structures 91 hold the wires in parallel a cross-sectional pattern and electrically insulate the wires from each other, and in particular the primary circuit is electrically insulated from the secondary circuit. One-to-one mapped wire connection arrangements 93 of wire segments with a pattern as shown in FIG. 3 connect the wires of the support structures 91. Connection arrangement 99 of wire segments connects the wire ends in front faces 95 of support structures 91, mapping the connections two wires shifted to the right for each iteration, with a connection pattern as described and shown in the structure of FIG. 4. A central space 97 is defined between structures 91, and it also has no central core, in contrast with conventional coaxial transformers.

Figure 10:
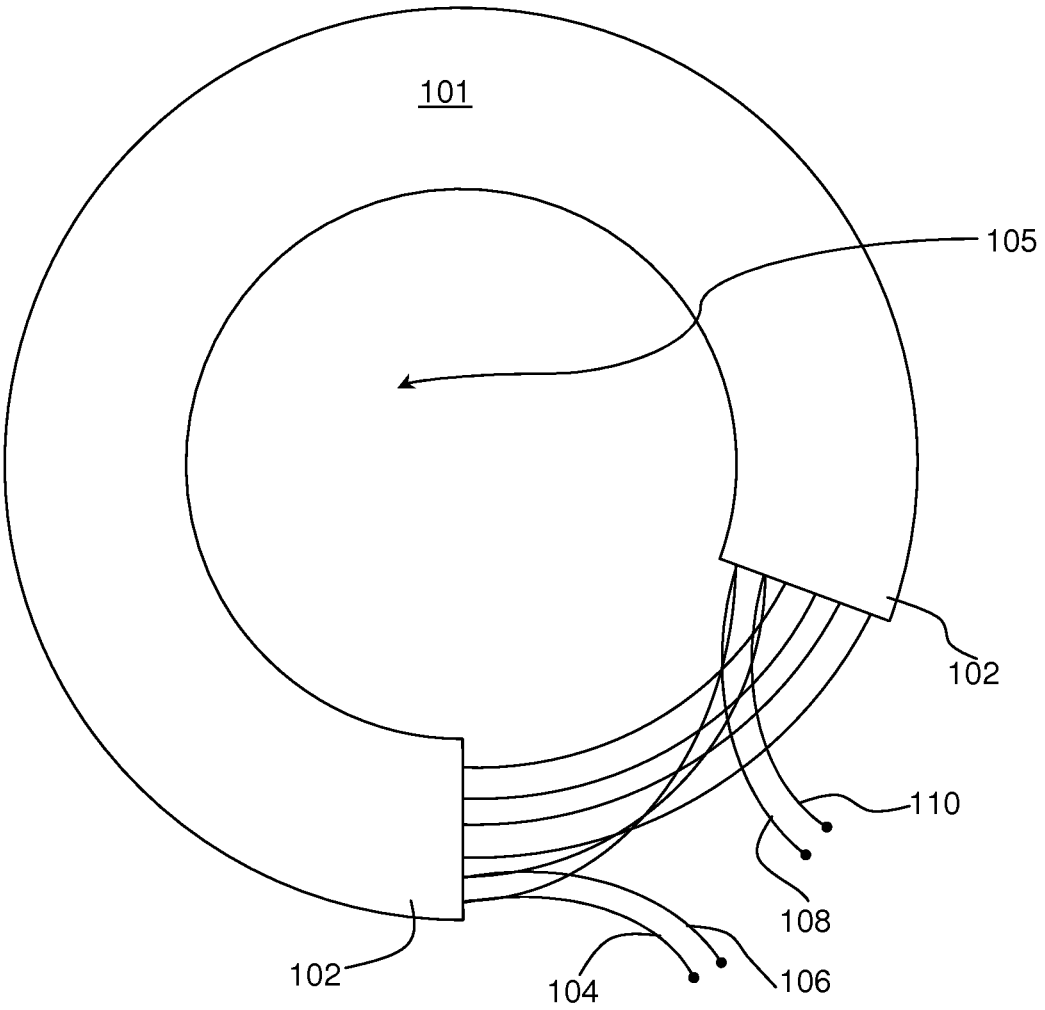
FIG. 10 is a schematic diagram of still another alternate embodiment of the invention, wherein the circuits of the transformer are supported in a single arcuate wire-supporting structure.

FIG. 10 shows a schematic view of another alternate embodiment of the invention having only a single support structure 101. The primary circuit connects to a power source via leads or wire segments 104 and 108. The secondary circuit connects to a load via wire segments 106 and 110. Support structure 101 holds the wires in a cross-sectional pattern, e.g., a 6×6 matrix, constant over the entire length of the structure 101, with the wires electrically insulated from each other and extending through side-by-side passages in the structure 101. In particular, the primary circuit is electrically insulated from the secondary circuit and held at a constant spacing therefrom. A connection arrangement 103 of wires connects the wires of the two ends 102 of the support structure. The arrangement is similar to that shown in FIG. 4, with wires in one end 102 being connected to wires in the other end 102 shifted over by two wires, or in the next row upward, although other patterns that maintain the alternating primary and secondary circuit wire pattern may also be employed. The structure 101 defines therein a central space 105. Central space 105 is empty, and lacks a central core, which is in contrast with conventional coaxial transformers that usually have an iron or other metallic core.

Figure 11:
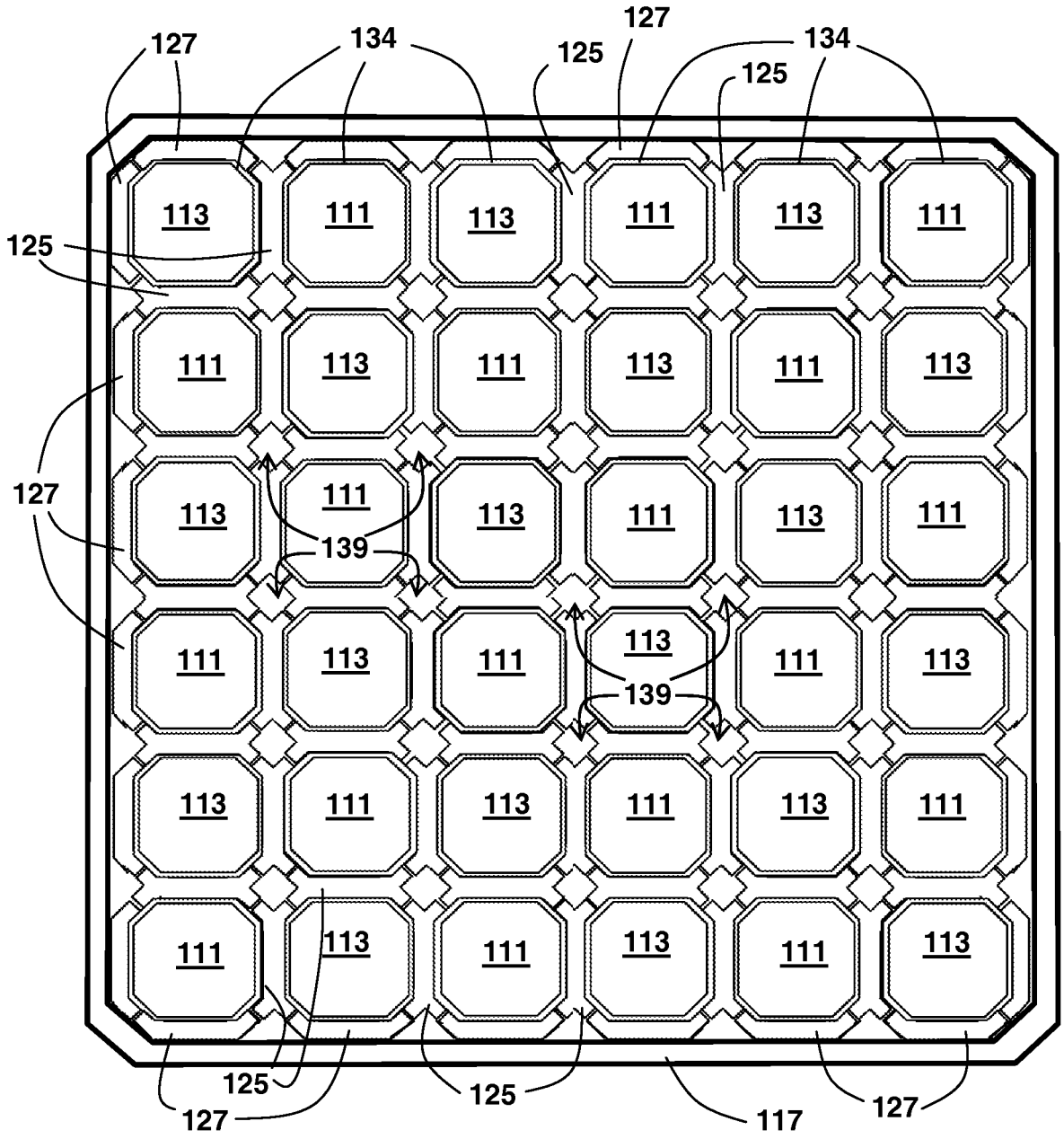
FIG. 11 is a schematic diagram of a cross section of a wire support structure of another alternate embodiment, in which magnetically permeable elements are provided in the structure between the wires of the circuits.

FIG. 11 is a cross-section of an alternate embodiment of wire support structure, which may be used in place of the support structures of any of the previous embodiments. The structures between the wires modify the magnetic fields produced by the primary circuit. Wires connected so as be the primary circuit are indicated schematically at 111 and wires connected so as be the secondary circuit are indicated schematically at 113. The wires 111 and 113 may be single insulated wires, twisted wires in insulation, or bundles of mutually insulated parallel wires may be used.

The wires 111 and 113 extend through passages lined by a surrounding sheath 117 that preferably also holds the wires in place. Wires 111 and 113 are arranged in an alternating pattern, and here form a six by six (6×6) matrix, but other sizes of matrix can be used. The alternating of wires 111 and 113 results in each primary-circuit wire 111 having four secondary-circuit wires 113 arranged around it extending alongside in a constant cross section over the length of the wires 111 and 113 above and below in its column, and left and right of it in its row. The wires on the outer surface of the matrix arrangement, i.e., adjacent to sheath 117 are an exception, and have fewer wires around them.

Wires 111 and 113 extend through a lattice structure formed by elements of high magnetic permeability 125 and 127 surrounding the wire segments. The wire segments are insulated from each other and from the elements 125 and 127. Elements 125 and 127 are plate-like and planar, with the flat faces of the elements being perpendicular, i.e., normal, to the direction of extension of the wires, and the elements 125 and 127 are preferably supported in stacks, with the stacks extending over the entire length of the wires 111 and 113.

The elements are notched to allow room for cooling sections 139 to run along the length of the wires 111 and 113. The cooling sections 139 may contain air, or another material, including solids and fluids, and a thermal cooling system may be connected to move the fluids. The wires 111 and 113 are arranged around cooling elements 139 such that each cooling section 139 is a junction around which the wires 111 and 113 alternate.

Figure 12:
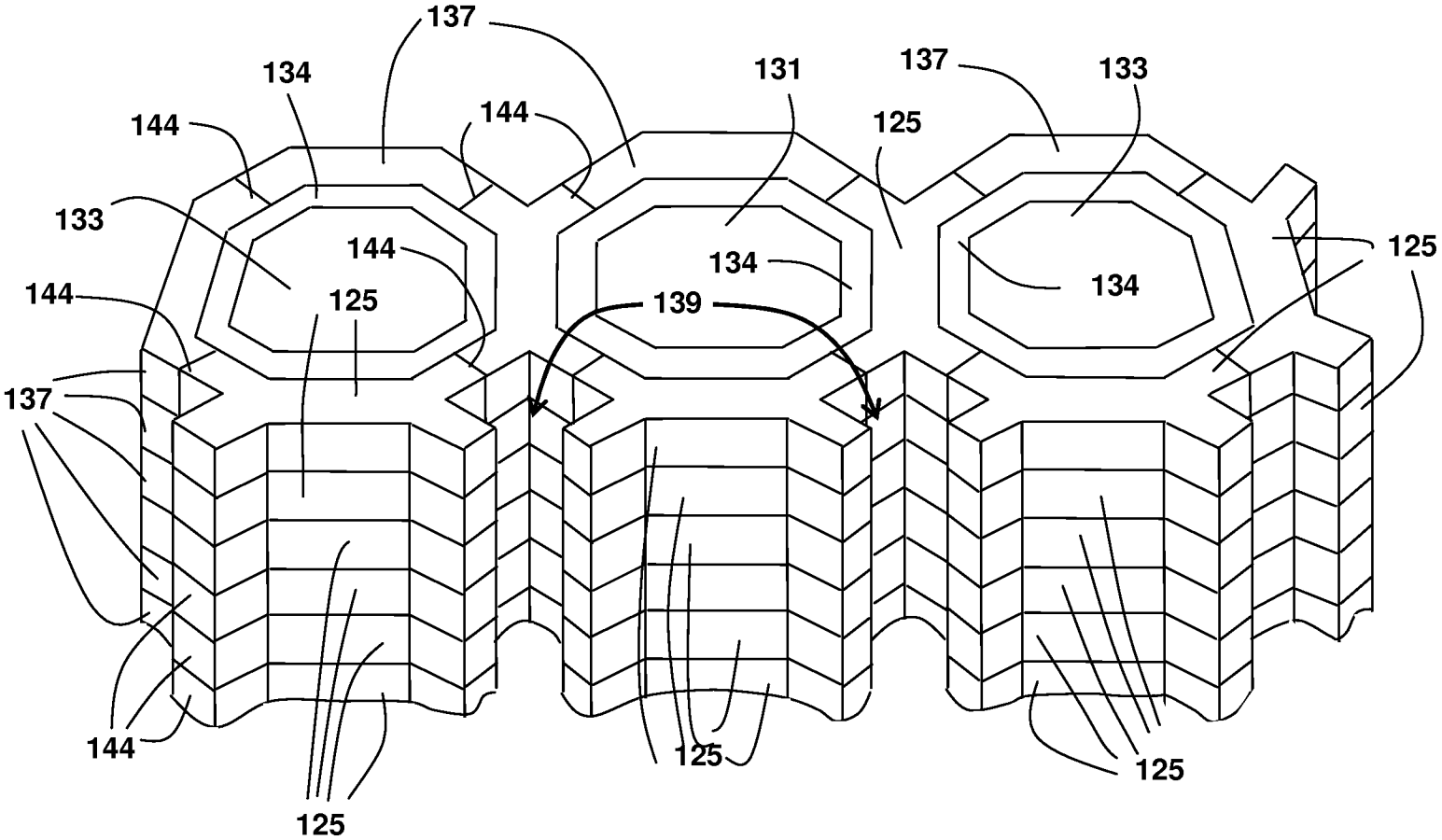
FIG. 12 is a perspective detail view of the wire support structure of FIG. 11.

FIG. 12 shows a partially cut away perspective detail view of a support structure as shown in FIG. 11. Wire segments schematically indicated at 131 are in the primary circuit and wire segments schematically indicated at 133 are in the secondary circuit, and the primary and secondary wires are arranged in an alternating pattern as in FIG. 11. In addition, elements of high magnetic permeability 135 and 137 surround the wire segments. The elements are notched and surround cooling sections 139. The wires of the primary or secondary circuits are surrounded by a lattice of the elements 135 or 137 over the length of the wires. The elements are plates, and a single element only covers a small portion of the length of a wire, so they are stacked over the length of the support structure. The elements are insulated from each other, and by individual lamination for insulation, or the insulation may be air or another insulating material. Particularly preferred as an insulator is transformer oil. The wire segments themselves have insulation 134 around the passages through which they extend. Insulation 134 insulates the wire segments from each other and from the elements 135 and 137.

Figure 13:
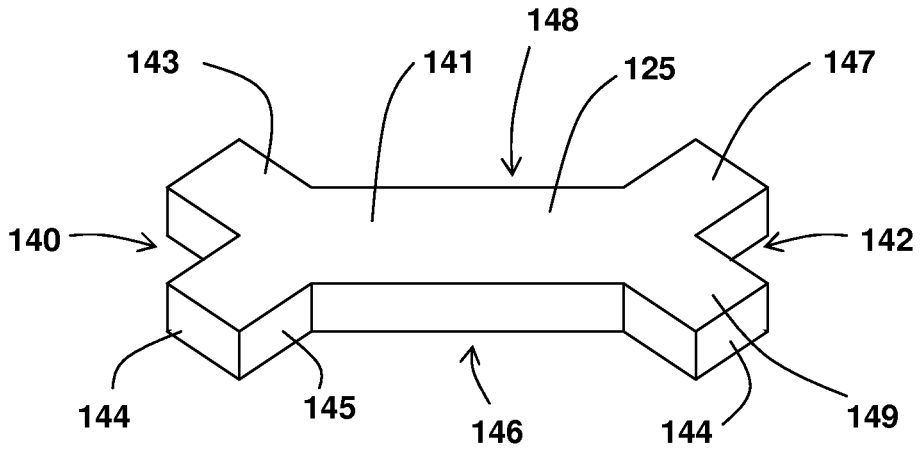
FIG. 13 is a perspective view of a magnetically permeable element of the embodiment of FIG. 12.

FIG. 13 is a perspective drawing of an element of high magnetic permeability 135. As mentioned above, the element 135 is preferably completely made of a magnetically permeable material, e.g. a ferritic material. The element 135 has a narrowed central portion 141, and forked prongs 143, 145, 147 and 149. The prongs 143, 145, 147 and 149 are set at approximately 45° angles from the central portion 141, and each terminates in a perpendicular face at 45° to the central portion 141.

The AC current passing through the core can give rise to a momentary magnetic north pole and a magnetic south pole, e.g., North at prongs 143 and 145 and South at prongs 147 and 149, and then these magnetic poles will be immediately reversed when the AC current changes to the opposite direction.

Each element 135 has four indentions or recesses 140, 142, 146, and 148. Elements 135 and indentations 146 and 148 are sized such that the elements 135 fit between conductors, e.g., conducting wires 131 and 133 as in FIG. 12. The indentations 140 and 142 are sized to provide the cooling sections 139, which may be used as an electrical insulator and/or for thermal cooling.

Figure 14:
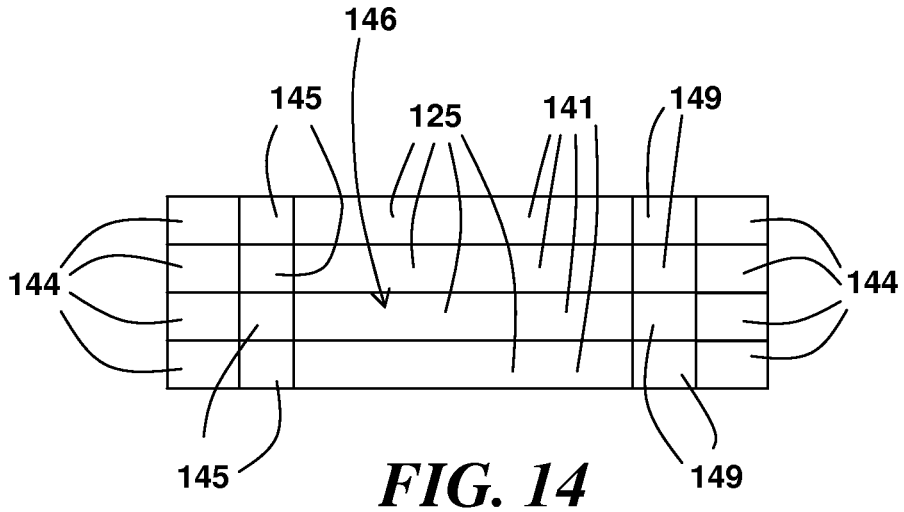
FIG. 14 is a detail front view of stacked magnetically permeability elements as shown in FIG. 12.

FIG. 14 is a side view of a stack of laminated elements 135 as in FIG. 13. The core's height is small compared to the length of a wire of a circuit. The elements 135 are preferably insulated from adjacent elements 135 above and below them, by, e.g., lamination, transformer oil, or some other relatively thin insulator. This reduces the formation of stray currents, which lead to reduced efficiency and unwanted heat buildup.

Figure 15:
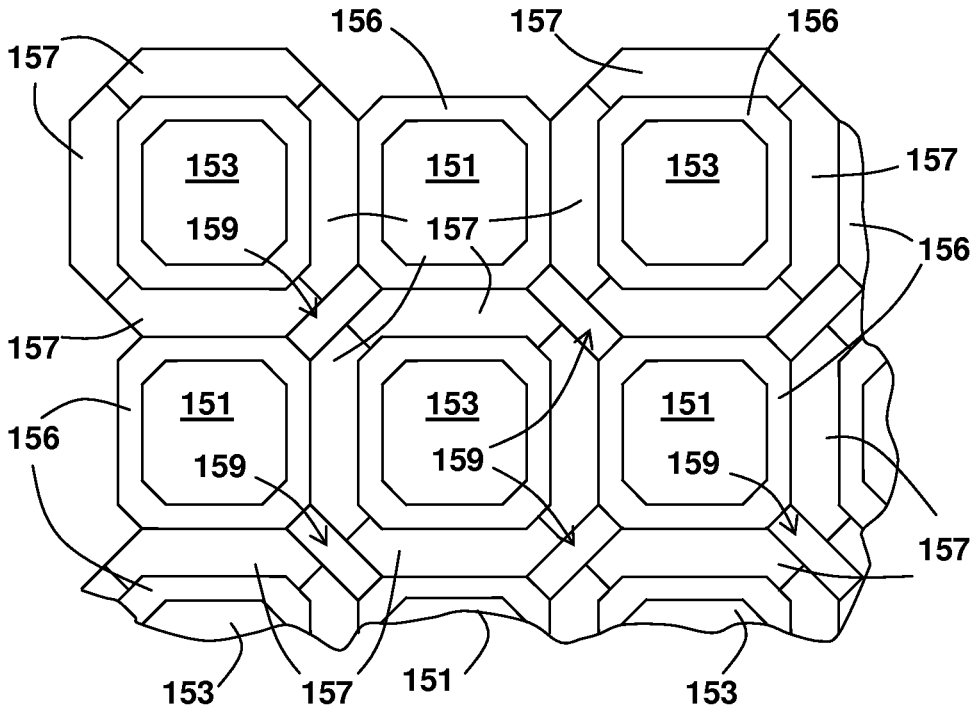
FIG. 15 is a schematic of a cross-section of another embodiment of the invention in which magnetically permeable elements are present between the circuit wires.

FIG. 15 is a cross-section of a support structure. Wire segments belonging to the primary circuit 151 and wire segments belonging to the secondary circuit 153 are arranged in an alternating pattern. Cores of high magnetic permeability 157 surround the wire segments of the primary circuit. The wire segments are insulated from each other and from the cores by insulation 156. Cooling element 159 is found between cores and may be air or other thermal conductor.

Figure 16:
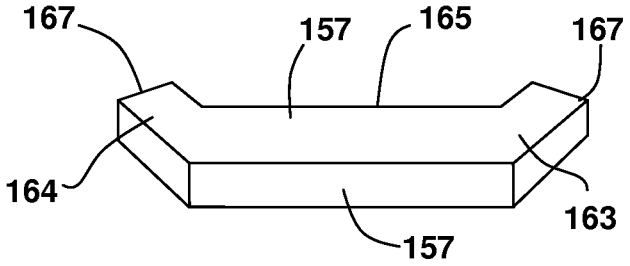
FIG. 16 is a perspective view of a magnetically permeable element as shown in FIG. 15.

FIG. 16 is a perspective drawing of a single general U-shaped element of conductive or ferromagnetic material 157. The element 157 has central section 161, and prongs 163 and 164. The element also has indentation 165, which is sized to fit around a conducting wire, e.g. wire 151. The prongs 163 and 164 are set at an approximately 45° angle from the central section 161 and provide faces 167 at 45°. During the application of AC power to the transformer, the elements 157 may be magnetized by the AC current, such that, momentarily, prong 163 has one magnetic pole and prong 164 has the other magnetic pole, and that magnetic polarity is reversed when the AC current reverses its polarity.

Analogous types of metallic structures may be employed between the wires of the hexagonal pattern of FIG. 6, allowing for lengthwise cooling passages.

The foregoing embodiments have primary and secondary circuits that are of effectively the same length, which results in the voltage of the current of the secondary circuit being similar to that of the current in the primary circuit. Transformers of that sort have some utility, e.g., to smooth the voltage of an incoming current that fluctuates markedly. However, transformers normally are employed to change the voltage of the incoming current to a higher or lower voltage.

That is accomplished in the present invention by increasing the length of the wiring of the primary and/or secondary circuits. The length of a circuit is accomplished by increasing the number of wires in each wire passage P or S in the wire support structures, and connecting those wires in series, extending the length of the given circuit, as will be described below. The resulting output voltage of such a transformer is the input current voltage multiplied by a ratio corresponding to $L_S/L_P$, where $L_P$ is the length of the primary circuit in the transformer system, and $L_S$ is the length of the secondary circuit in the transformer system. In fact, due to losses of power in the coils, the actual output voltage will drop by about 5% to 6% relative to the input voltage times the ratio of $L_S/L_P$, or expressed in formula form:

$$V_{out}=(V_{in}-\text{Loss})(L_S/L_P)$$

This may be overcome by lengthening the secondary coil relative to the primary coil, so as to increase the value of the ratio $L_S/L_P$ so as to compensate for the loss, and obtain the desired output voltage $V_{out}$ for a given input voltage $V_{in}$, as will be described below.

Figure 17:
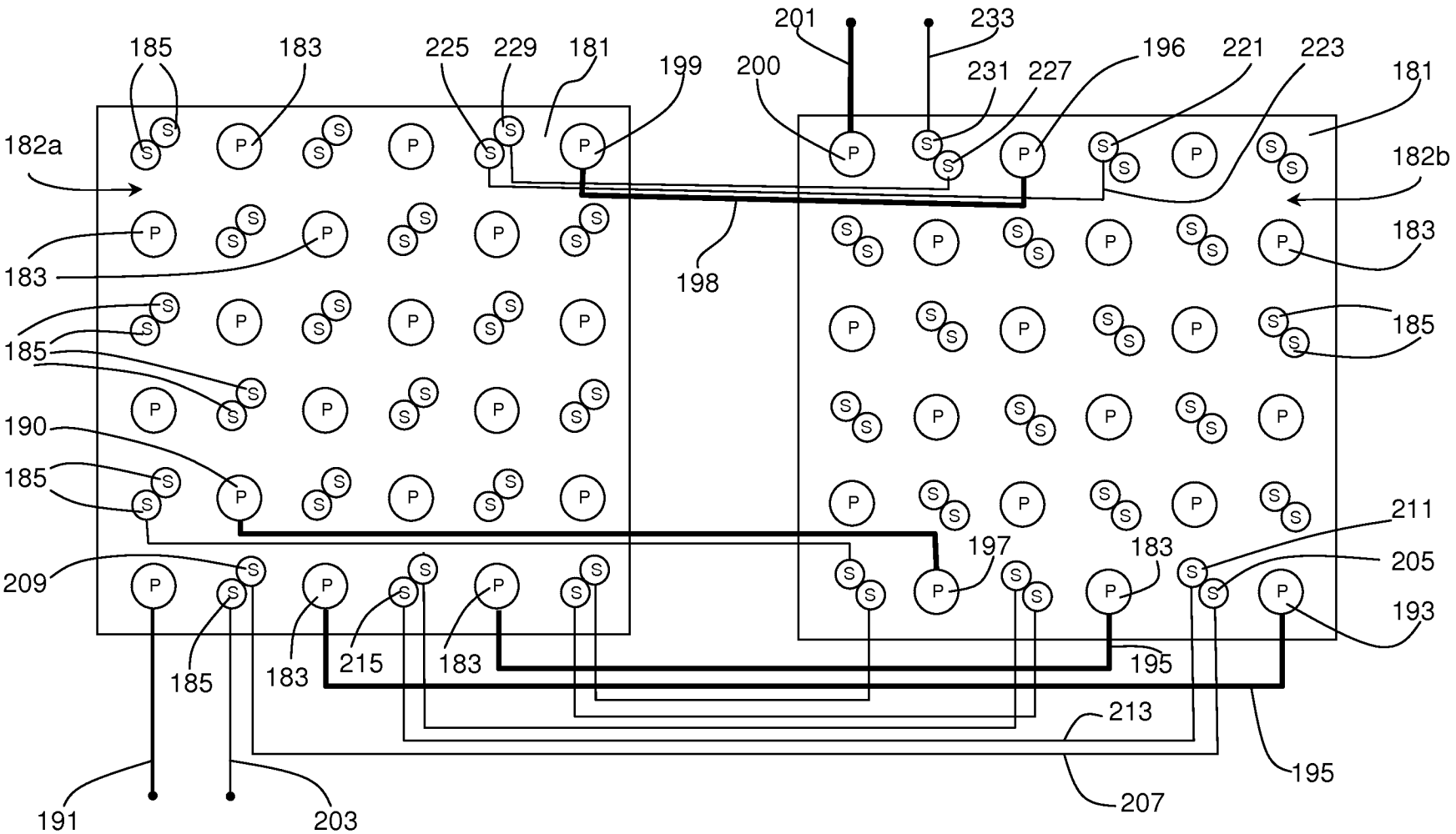
FIG. 17 is a schematic diagram of a cross-section of another embodiment of the invention that allows for a 2:1 increase in voltage of current applied to the transformer.

FIG. 17 shows a schematic of an alternate embodiment of the invention providing a 2:1 step-up transformer that may be used in, e.g., circuits such as seen in FIG. 1. The support structure 181 has wire connection faces 182*a* and 182*b* that provide access for connections to wires 183 forming the primary circuits (each indicated with a P), and wire segments 185 forming the secondary circuits (each indicated with an S) extending through passages supporting them in the support structure 181.

Support structure 181 may be a unitary structure, such as in FIG. 10, connecting between faces 182*a* and 182*b*, or it may be made up of one or more subsidiary support structures as in FIG. 1, 8, 9 or 10. Where the transformer is made up of separate support structures 18 as seen in FIG. 1 or 81 or 91 in FIG. 8 or 9, the connections between the separate structures are preferably a one-to-one direct connection to the similarly located wire in the next structure, so that each wire 183 or 185 connects with the wire in the same position in the next support structure, and the wire ultimately extends from the last face 182*b* in a left-right minor-image position compared to the position at which it enters face 182*a*. The end faces 182*a* and 182*b* correspond to the end faces 18 (FIG. 1), the faces connected by wiring 87 (FIG. 8) or end faces 95 (FIG. 9), i.e., the faces of the first and last structures. Similarly, if the support structure 181 is a continuous loop such as generally illustrated in FIG. 10, the end faces 182*a* and 182*b* correspond to end portions 102 in FIG. 10.

Referring again to FIG. 17, for every wire 183 of the primary circuit P there is a pair or set of wires 185 of the secondary circuit S. Wires 185 extend over the length of the support structure(s) 181 through a respective shared passage therein. The wires of a given pair may extend straight through the structure, or the wires 185 may be twisted around each other. The wires of the pair in either case are supported so that the midpoint of the pair over the length of the support structure 181 is located in a central position surrounded by four primary circuit wires 183 rotatively distributed at equal angles of 90 degrees about that center point of the wire pair 185, except for wire pairs 185 on the outer surface of the carrier 181, which have one or more of those four surrounding wires 183 not present. The wires 185 of the secondary circuit may have a smaller diameter than the segments 183 of the primary circuit.

The wiring of the circuits is shown in the schematic of FIG. 17. The connection to the power source is via wire 191, which connects to the first wire in the bottom row of the wire ends of face 182*a*. This wire extends through the carrier 181 and connects with the wire end that extends out through the last position in the bottom row of face 182*b* indicated by reference number 193. A circuit connective wire 195 extends from this connection to the next primary circuit wire 183 to the right in the bottom row of face 182*a*, which in turn connects through the support structure 181 to the second rightmost primary circuit wire 183 in the bottom row of face 182*b*. The end of that wire in turn is connected by a spiral wiring connector 195 to the next wire 183 to the right in the bottom row in face 181*a* of the primary circuit P. This incrementally rightward shifting wiring pattern continues through the bottom row to the next position of wire 183 of the primary circuit P indicated at 197, which is the leftmost wire of the primary circuit in the bottom row of face 182*b*. That wire end 197 is connected with the first wire 190 of the primary circuit P in the next row up. The pattern of connections continues with spiraling circuits (not shown here for clarity of the diagram) made through the matrix of wires 183 of the primary circuit. The final loop of the primary circuit is made between wire 196 in the upper row in face 182*b*, which is connected via a spiral linking wire 198 to the final primary circuit wire in the top row 199 of face 182*a*, which connects through the support structure 181 to the leftmost wire 200 of the primary circuit P in the upper row of face 182*b*. This wire 200 is connected by conductor 201 to the other pole of the power source.

The wiring of the secondary circuit S is analogous to that of the primary circuit P, but because there are two wires in each passage it allows for two loops to be formed through each of the wire pairs 185 in the structure 181. Wire 203 connects from one side of the load for the transformer to a first wire 185 of the secondary circuit S in the bottom row of face 182*a*. This wire connects through to the mirror image wire 205 of the secondary circuit S in face 182*b*. A secondary-circuit circuit connecting wire 207 connects this wire 205 to the other wire 209 in the first wire pair in the first row of face 182*a*. Wire 209 extends around through the structure or structures 181 to wire end 211 in face 182*b*. Wire 211 connects via circuit forming connection wire 213 to the first wire 215 of the next pair of secondary circuit wires 185 in the bottom row of face 182*a*.

The incremental shifting connection pattern repeats with a subsequent connection between the first wire of each pair of wires 185 in face 182*b* to the second wire of the pair of wires 185 in face 182*a*. The second wire in the face 182*a* extends through to face 182*b* and is connected to the first wire of the next pair of wires 185 to the right in face 182*a*. This pattern is repeated again and again throughout the body of the structure 181 with two loops of the secondary circuit S being formed for every loop of the primary circuit P.

The final two loops of the secondary circuit S are formed by the end of wire 221 in the top row of face 182*b*. Wire 221 is connected by circuit connecting wire 223 to the first wire 225 of the last pair of secondary circuit wires in the top row of face 182*a*. This wire 225 connects to the corresponding wire 227 in face 182*b* which in turn connects with the second wire 229 of the last pair of wires 185 in face 182*a*. Wire 229 connects through the final wire end 231 in face 182*b*, which is connected with a conductor 233 going to the other side of the load to which the transformer is attached.

Although the arrangement of FIG. 17 of a support structure with passages carrying two wires in a secondary circuit and a single wire in a primary circuit allows for a 1:2 change in voltage, differentiations in voltage besides a simple 1:2 conversion or the reverse are frequently desirable. To obtain a different ratio of voltage in and voltage out, a transformer may be used with support structures such as are shown in FIGS. 18A and 18B.

Figure 18A:
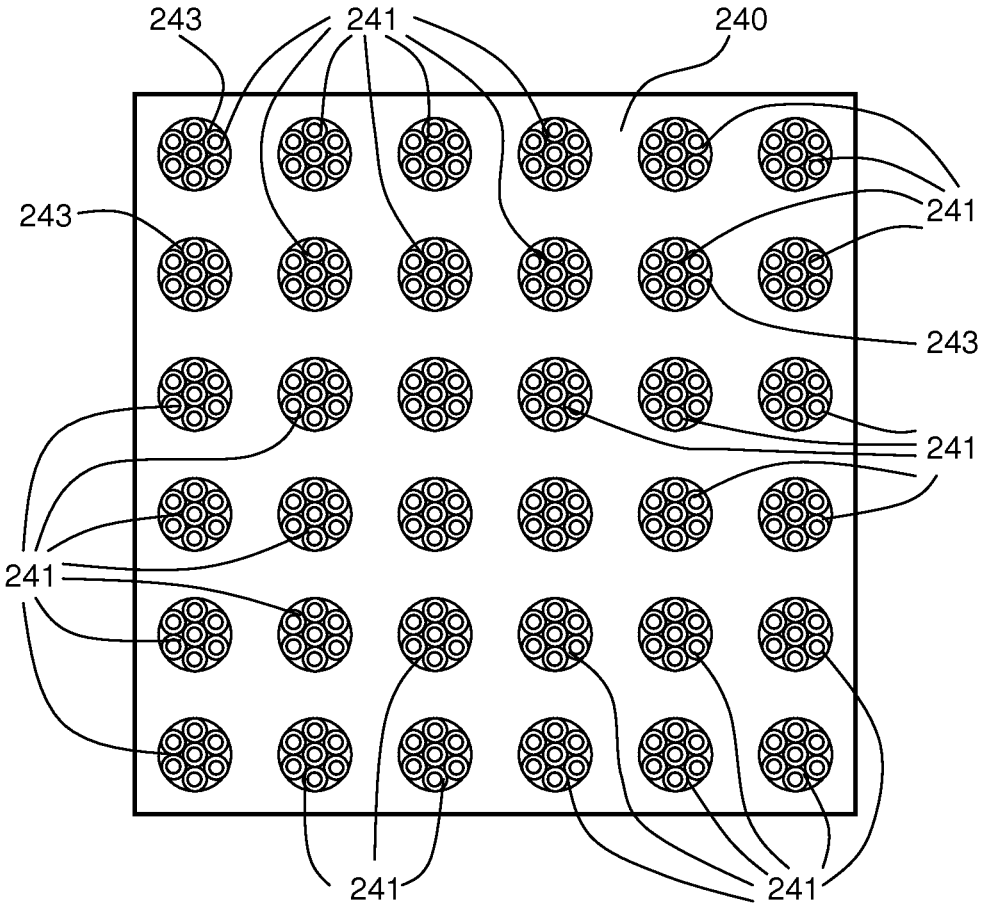
FIG. 18A is a schematic of a cross-section of another embodiment of the invention in which the primary and secondary circuits are formed of bundles of wires in the support structures in a rectangular matrix pattern.

Referring to FIG. 18A, a matrix arrangement of 6×6 multiple wire bundles 241 is shown. The wire bundles 241 are supported in passages 243 in the support structure 240. The passages 243 are arranged in six rows of six passages each, and each passage in the interior of the structure 240 has four immediately adjacent passages around it, staggered rotatively at equal angles of 90 degrees. However, a matrix of virtually any rectangular structure can be used. The bundles of wires shown have seven wires per bundle 241, but the number of wires in the bundles may vary from two up to any number. The wires in bundles 241 may extend straight and continuously through the supporting aperture 243 or they may be twisted about the lengthwise centerline of the bundle. All of the wires in the bundles 241 supported in the apertures 243 in the carrier 240 are of typical configuration, i.e., each has a conductor inside a surrounding insulator, so that all the wires in the bundle are electrically separate from one another.

Figure 18B:
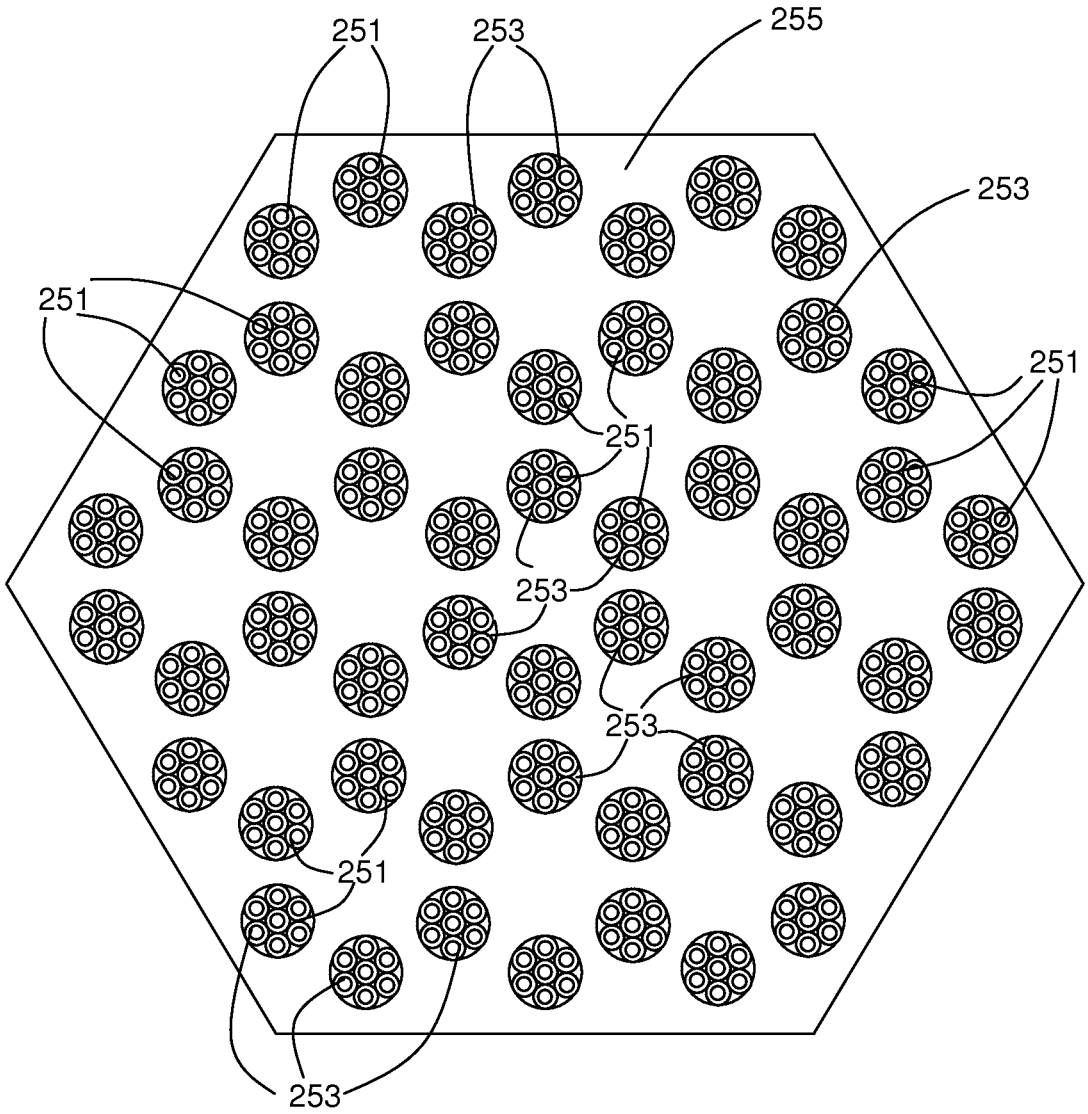
FIG. 18B is a schematic of a cross-section of another embodiment of the invention in which the primary and secondary circuits are formed of bundles of wires in the support structures in a hexagonal close-packed pattern.

FIG. 18B shows another embodiment wherein similar bundles of wires 251 are each supported in a respective supportive passage 253 passing through the body of support structure or carrier 255. Each of the bundles comprises seven wires, but may have fewer or more than seven wires, as needed for the application. The passages 253 supporting the bundles of wires are organized in a hexagonal pattern that can be assembled with other similarly arranged passages to extend out to almost any overall outer support structure shape, but especially a hexagonal outer shape. The number of passages of bundles of wires can be increased to as large a system as is desired, depending on the application.

The wires in each bundle are all insulated from each other, so that they can carry different currents and be connected in a variety of ways to each other, e.g., all in series, all in parallel, or some mixture thereof, or some being left out to select the desired output voltage relative to the input voltage for the transformer.

Figure 19:
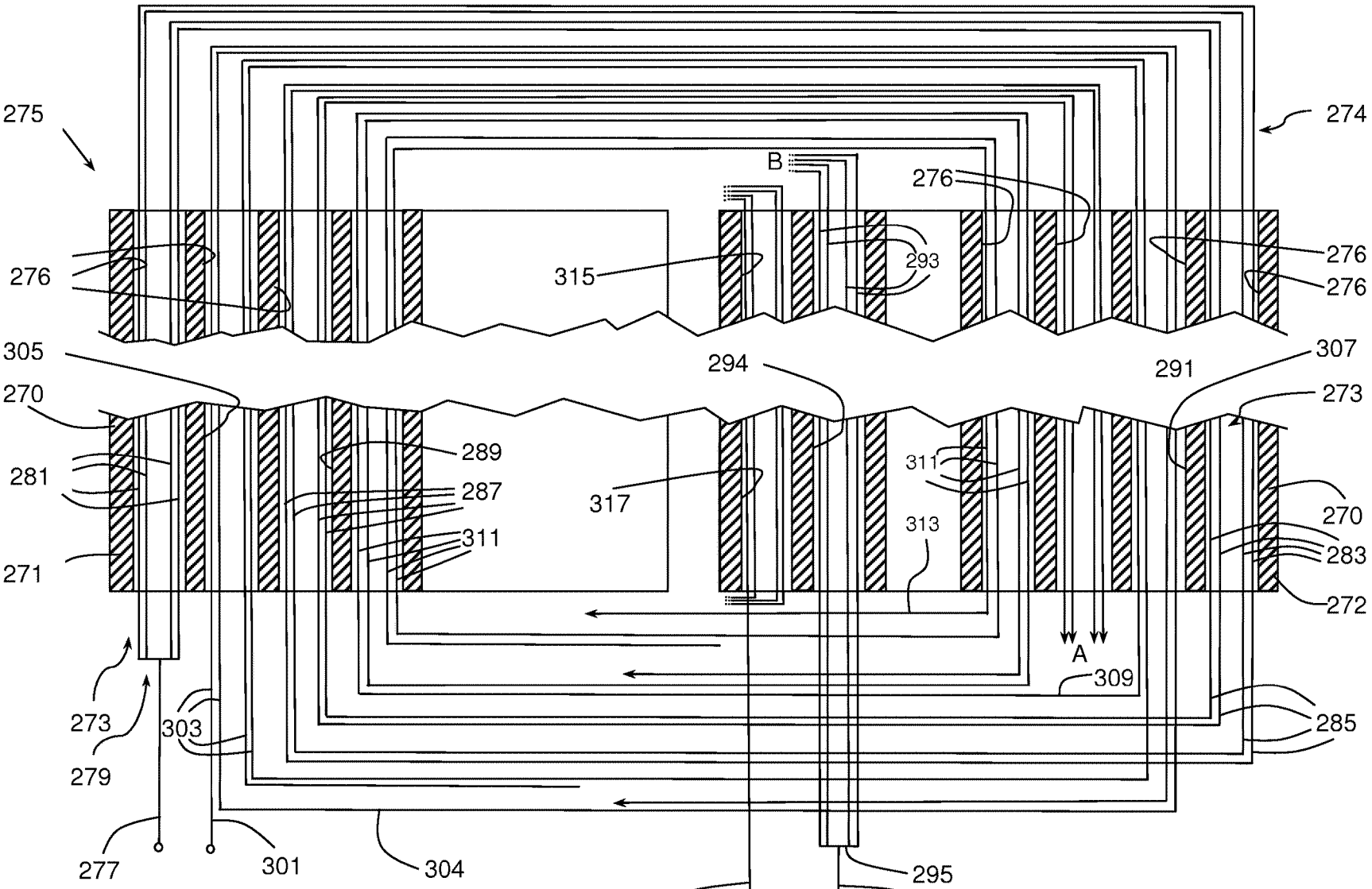
FIG. 19 is a schematic illustrating the wiring of a step-up transformer according to the invention.

FIG. 19 shows an exemplary schematic for a transformer that shows how different comparative voltage levels between the input and output currents can be arranged in a transformer.

FIG. 19 shows the schematic of a step-up transformer 275 according to the invention that increases an incoming voltage to a higher outgoing secondary circuit voltage. The transformer includes two or more support structures 270 having front ends 271 and 272. Alternatively, there may be more than two structures arranged in series as in FIGS. 7 to 9, or the front ends may be parts of a single unitary support structure such as in FIG. 10.

Where the transformer comprises two or more support structures 270, the support structures 270 have rear ends connected by direct parallel wiring 274, wired so that the wires entering end 271 extends through the support structure, through the associated wire 274, and through the other support structure(s) 270, to lead directly to the minor image wire position in end 272.

The support structures 270 are preferably of material such as thermoplastic, PVC or non-conductive material with particles of magnetically-effective material distributed therein such that the induction between the primary and secondary circuits is enhanced. Alternatively, other material may be employed, such as e.g., non-conductive ferritic or other material that enhances induction, or structures of discrete ferromagnetic elements surrounding the wires may be used, as described below. In any case, some sort of magnetically active material should be provided in the support structures 270 to enhance induction. The structures 270 have passages 276 extending through the structures over the length of the support structures 270.

When the support structures are straight, the passages 276 are all linear and substantially geometrically parallel to each other. If the structures 270 are curved in some way, such as arcuately as in FIG. 10, or some other non-straight path, the passages 276 extend adjacent each other over the length of the support structure with a constant relative position to each other in a plane perpendicular to the passages 276.

The passages are arranged in the support structure 270 in a cross sectional pattern such that the bundles of wires in the primary circuit, when viewed in perpendicular cross section thereto, are surrounded by three or more bundles of wires of the secondary circuit rotatively spaced about the lengthwise axis of the passage 276 in equal rotative angles about its lengthwise axis, e.g., 90 or 120 degrees. The cross sectional positioning pattern of the passages may be a hexagonal repeating pattern as seen in FIG. 18B or a rectangular matrix as seen in FIG. 18A, either arrangement having virtually any desirable dimensions or number of passages.

The passages each hold a respective bundle of wires 273 extending straight or twisted around each other through the passage 276. The number of wires in the bundle may vary from 2, 3 or 4, up to as much as 100.

The primary circuit is configured in the schematic of FIG. 19 as having the n wires in each bundle wired in parallel. The primary circuit is provided with power from a power source along incoming conductor line 277, which connects with a branch structure, indicated generally at 279, that connects with a plurality of conductors 281 extending through the first passage 276. The wires 281 extend through of the structure 270 of the transformer, wiring 274, and the other support structure(s) to emerge at end 272 as wires 283, all in parallel.

Outgoing primary circuit wire ends 283 are connected in parallel via linking wires 285 with a bundle or set of wires 287 that extending through the next alternating primary circuit passage 289 in the structure 270. The wires 285 remain connected in parallel over the length of the structure(s) 270 and wiring 274 to emerge as the wire ends in the minor-image located passage 291 in end portion 272.

Further connecting wires (not shown) connect with the wire ends indicated at A in parallel to the wires in the next alternate primary circuit passage 276 in end 271, and the primary circuit wires continue in a spiral progression connected with the wires of the bundles so as to extend in parallel through the passages and through the support structure 270. After the wires have been connected so the that the spiral circuit of the primary circuit extends through that half of the passages in the structure 270 that support the primary circuit, except the last one, the parallel wiring of the primary circuit reaches a connection point indicated at B, wherein the last set of wires of the primary circuit indicated at 293 extend through the final primary circuit passage 294. On emerging from end 272, wires 293 connect to a combining branching structure 295 that connects all of the wires 293 to conductor 297, which leads to the other pole of the power source. This connection completes the primary circuit extending through the support structure 270 and then out to the power supply.

The secondary circuit has a different set of connections connect the wires in each of the bundles in the secondary-circuit passages to be connected in a series rather than in parallel as in the primary circuit. The secondary circuit is connected via conductor 301 to one of the wires 303 of the bundle of n wires 303 extending through the first passage 305 in the support structure 270. The wires 303 extend through this opening 305 and around to the passage 307 in end 272. The wires 303 there are connected so as to shift over one wire in the given bundle of wires, i.e., the first wire passing through passage 305 after making the circuit through the support structure(s) 270 is connected by a connection wire 304 with the second wire in the bundle of wires 303 in the passage in end 271. This second wire goes through the structures 270 and emerges at the other end 272, where a connecting wire connects it with the third wire 303, which loops through the structure 270 and is connected with the fourth wire 303, and so on and so on until the nth wire 309 in the bundle passes through end unit 272.

The nth wire 309 is connected with the first wire in the bundle of wires 311 in the next secondary circuit passage. The pattern of connections is repeated, i.e., the first wire emerging from the bundle at end 272 is connected with the second wire of the same bundle in end 271, the second is connected to the third, etc. until the nth wire, which connects to the first wire of the next bundle in the next secondary-circuit passage, and then emerges to connect with the second wire of the bundle 311, and so on, until the last wire of this bundle indicated at 313 emerges and extends to connect with the first wire of the next bundle of secondary circuit wires (not shown in FIG. 19). This results in a spiraling series of n loops of the secondary circuit for each passage.

After the secondary circuit has run through all of wires of the secondary circuit bundles in series in the support structure it arrives at the final passage available for the secondary circuit, generally indicated at 315, and iterates through the passage as previous passages up to the nth wire 317. The final wire 317 of the final bundle extends through end portion 272 and connects to a conductor line 319, which is connected with the other pole of the transformer load, which is connected between wires 301 and 319.

The passages 276 supporting the primary circuit bundles and the passages 276 supporting the secondary circuit bundles are preferably selected so that the arrangement of primary circuit bundles is similar to that of FIG. 2 or 5, i.e., with the primary and secondary circuits alternating in each row and column so that four secondary circuit bundles are distributed rotatively at 90 degree displacements about the centerline of each primary circuit bundle, and four primary circuit bundles are distributed rotatively at 90 degree displacements about the centerline of each secondary circuit bundle, with the exception of the bundles adjacent the outer surface of the support structure 270. Alternatively, if the support structure has a hexagonal or other pattern, the rotative displacement is 120 degrees.

In either case, the wire bundles extend parallel (if linear) or continuously adjacent each other along adjacent substantially identical pathways that are physically close to each other, less than 0.25 inches and preferably less than 0.05 inches to provide for efficient transmission of power between the bundles. The magnetic flux that creates the current in the secondary circuit is caused by the bundles of wires of the primary circuit having this adjacent positioning of the wires of the secondary circuit extending next to them. The transmission is efficient, and the amount of magnetic field outside of the support structures 270 is relatively low compared to simply a single wire carrying the current that is supplied to the primary circuit.

This provides for a step-up transformer that increases incoming voltage by a ratio of 1:n where n is the number of wires in the secondary circuit bundles. A step down transformer may be formed by switching the connections of the power source and the load, so the primary circuit becomes the secondary circuit, and the secondary circuit becomes the primary circuit.

The number of wires in each bundle can vary from 2 to 100 or more. Different ratios of voltage differences for step-up or step-down transformers according to the invention can be achieved by varying the arrangement of serial or parallel connections so that ratio of the length of the primary circuit from input connection 277 to output connection 297 to the length of the secondary circuit from input connection 301 to output connection 319 is the desired ratio of input to output voltage.

For example, a 120 volt input could be dropped to 5 volts by use of twenty-four-wire bundles (i.e., n=24), but with the primary circuit bundle wires being wired in series, and the wires of the secondary-circuit bundles being wired in parallel.

The pattern also can be a mixture of the parallel and serial arrangement. For example, if there are ten wires in the bundles, n=10, and the primary circuit might be connected so that the bundles each had five sets of two wires wired in parallel that were connected in series, and the secondary circuit bundles might have two sets of five wires wired in series. Such a transformer would have a ratio of $L_p/L_s$ of 5:2, resulting in a step down of 1:0.4.

Additional variations can also be made by reducing the length of the secondary circuit by placing some of the wires in that secondary circuit in parallel rather than series or just leaving them out of the connection so that they have no involvement with the transformer operation.

Also, to compensate for the loss of power that results in a slight drop in output voltage relative to input voltage time the ratio $L_P/L_S$, the secondary coil may be lengthened by selecting a larger number of secondary-coil wires in each passage 276, e.g., by using eleven wires instead ten wires in each passage of the secondary coil through the transformer for a 10:1 step up transformer.

Figure 20:
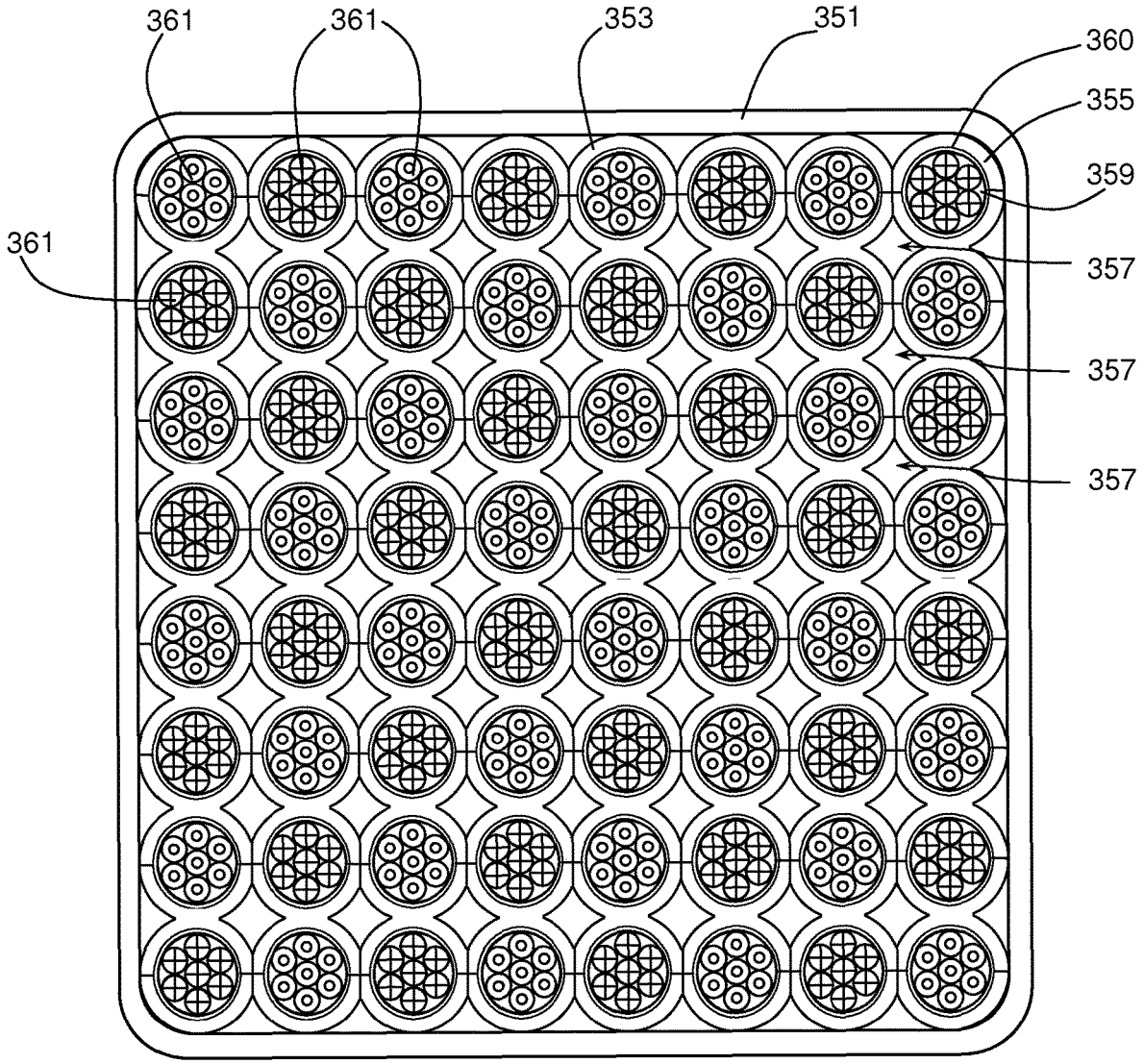
FIG. 20 is a diagram of another embodiment of transformer according to the invention, where the wires are surrounded by a lattice-type structure of material that influences the interacting magnetic fields between the primary and secondary circuits.

FIG. 20 shows another embodiment of transformer in cross-section with a different support structure. The transformer as shown has a housing 351 that encloses a lattice like support structure 353, which is formed of ferritic material. This material is generally a material made with iron ingredients, particularly the type of materials referred to as magnetic insulators or soft ferrite materials. Other non-iron containing material may potentially be used in this environment, but usually the material will be a ceramic homogeneous material composed of oxides of iron, with iron oxide as the main constituent. Other materials may be intermixed and can cause a modification of the crystal structure. Normally the ferrites used have a cubic crystal structure.

This material is formed into a lattice structure 353 that is comprised of a number of tubular conduits 355 formed integral with each other and defining therebetween a number of internal spaces generally indicated at 357, and also having therein essentially cylindrical straight passageways 359 that extend over the length of the transformer or the support structure. The connections of the wires, here shown as seven-wire bundles, are as in the previous structures, i.e., the wires connected to the primary circuit are alternated in the matrix with wires connected to the secondary circuit, the wires of the different circuits being differentiated by the symbols O and X. Bundles of multiple wires are shown in the figure, but single conductors may also be used, and the wires may be connected with each other and the voltage source or the transformer load in series or parallel, as discussed above. The spaces 357 allow for a flow of coolant if desired, either a cooling gas or cooling liquid pumped therethrough.

The passages 359 include a plastic or other insulating material lining 360 that constitutes the lining of the passageway, and also might be considered to be a sheath surrounding and binding together the bundles 361 of insulated conductors extending through the passageways 359. As has been discussed before, the multiple wires in the bundles 361 are each an insulated wire that is insulated from the other wires in the bundle, allowing the wires to be connected relative to each other either in parallel or in series, or in some combination thereof, to achieve the desired output voltage based on the available input voltage.

Figure 21:
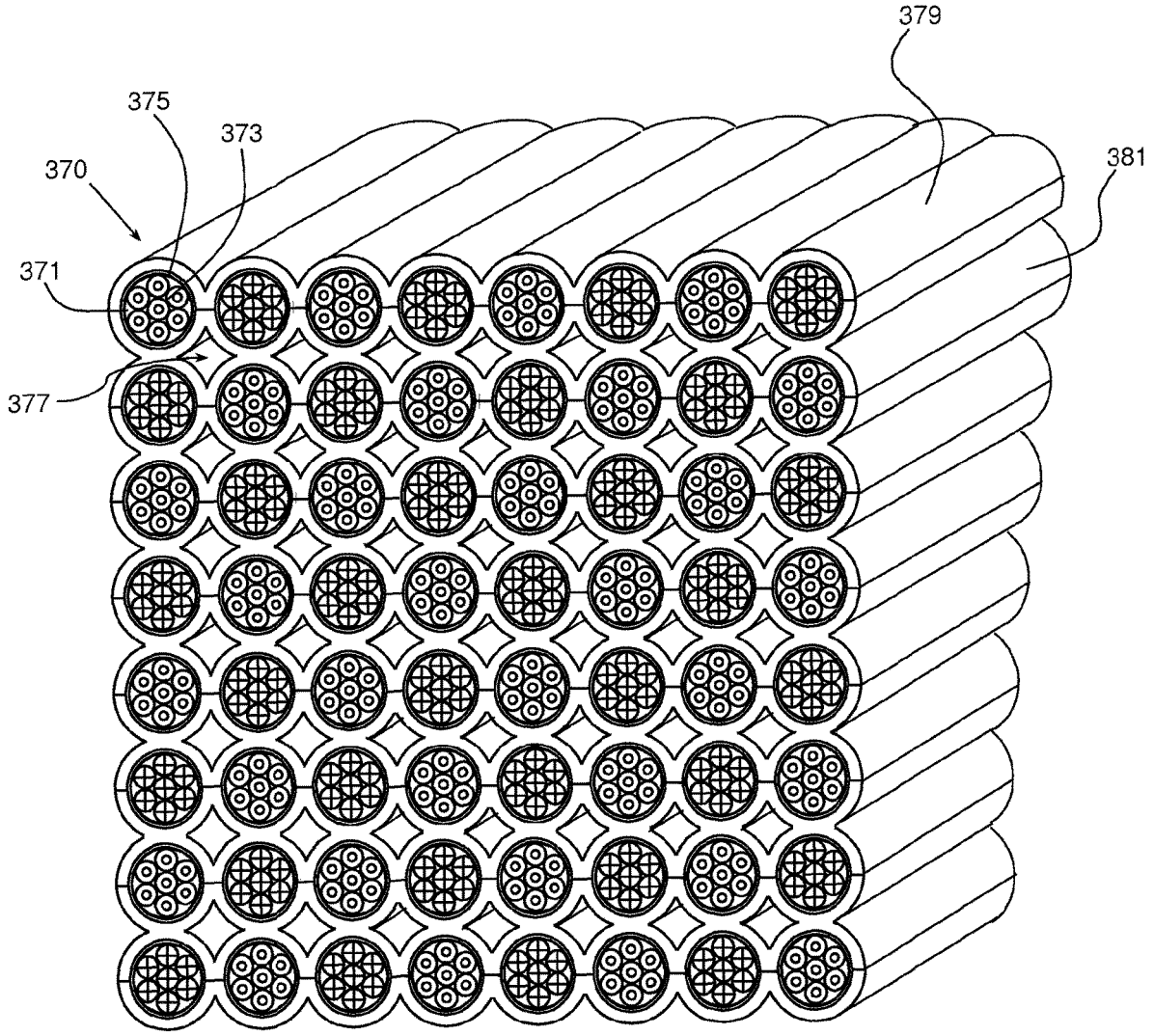
FIG. 21 is a perspective cutaway view of another alternate embodiment of wire support structure for a transformer according to the invention.

FIG. 21 shows another alternate embodiment of support structure that forms an enclosed system. In this alternate embodiment, a lattice structure 370 is shown that includes members defining an array or matrix of passageways 371 that each accommodates therein a bundle of mutually insulated conductors generally indicated at 373 surrounded by a sheath 375 of plastic or other insulating material. The lattice structure also has spaces or passages 377 therein that may be used for cooling, either by blowing cool gas or pumping cool liquid through them. The lattice itself is made up of discrete units or modular components 379 and 381 of the same soft ferritic material that has been discussed above.

These modular parts 379, 381 of the lattice extend approximately the length of the transformer support structure 370, and are in separate parts that are assembled by combining the complementary mating parts 379 and 381 to form the spaces 371 therein with the bundles of insulated conductors 373 in the passages where they are held in the matrix arrangement defined thereby.

It will be understood that similar ferritic lattice structures may be configured for a hexagon-based structure similar to that shown in FIG. 18B.

FIGS. 22 to 26 show a procedure by which a wiring structure that may be used in a transformer according to the invention can be manufactured.

Figure 22:
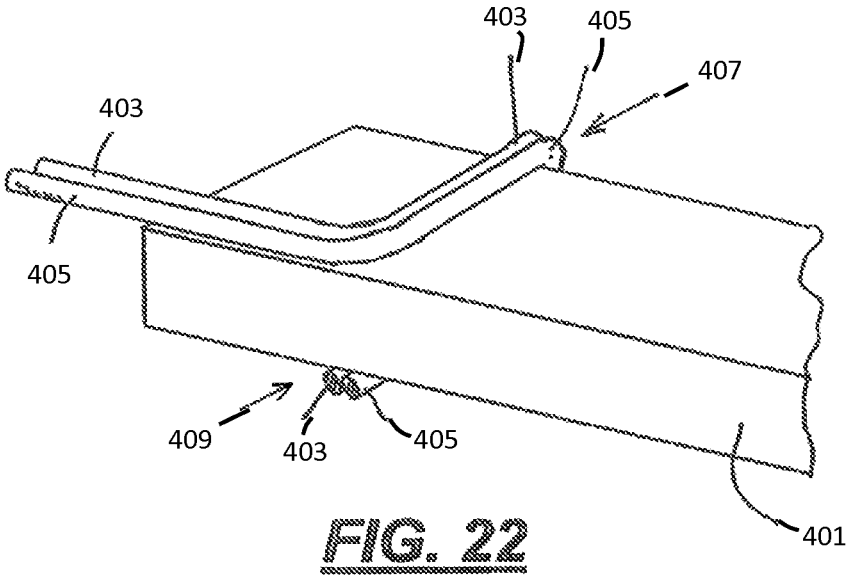
FIG. 22 shows the beginning of a wiring winding for making a transformer according to the invention.

Referring to FIG. 22, a central support member generally indicated at 401 has two insulated wires 403 and 405 extending therealong and that are wrapped around the support member 401. After a first loop 407 about the member 401 the wires reach the front of the member 401 at location 409 with a first wire 403 on the left and second wire 405 on the right.

Figure 23:
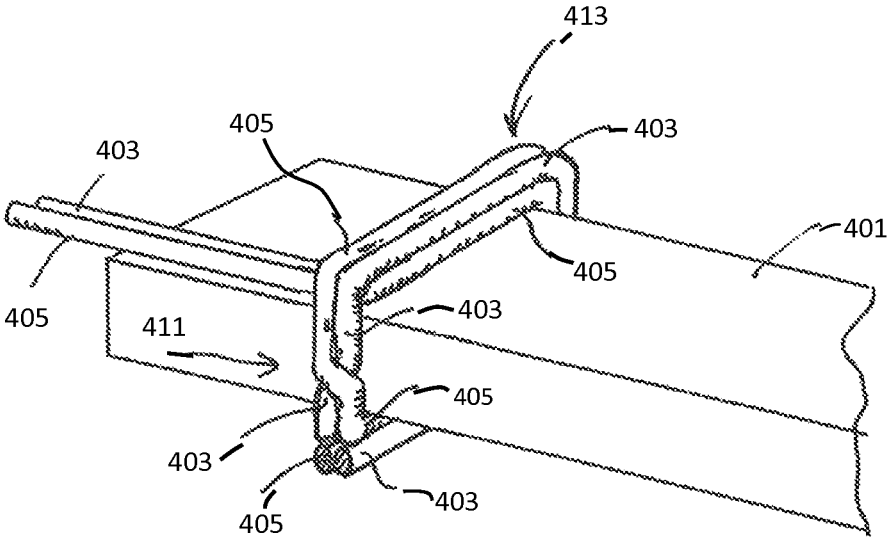
FIG. 23 is a view of the winding of FIG. 21 with an additional loop applied to the circuit.

Referring to FIG. 23, after the first loop is extended around the member 401, a twist generally indicated at 411 is introduced between the two wires reversing their position relative to each other so that wire 405 is on the left instead of the right as it proceeds around the loop, generally indicated at 413, around the member. Wire 403 is on the right and wire 405 is on the left, the reverse of the positions they were in in the first loop. By the end of the second loop 413 wires 403 and 405 present themselves at the front of the member 401 with wire 405 on the left and wire 403 on the right the reverse of their original arrival.

Figure 24:
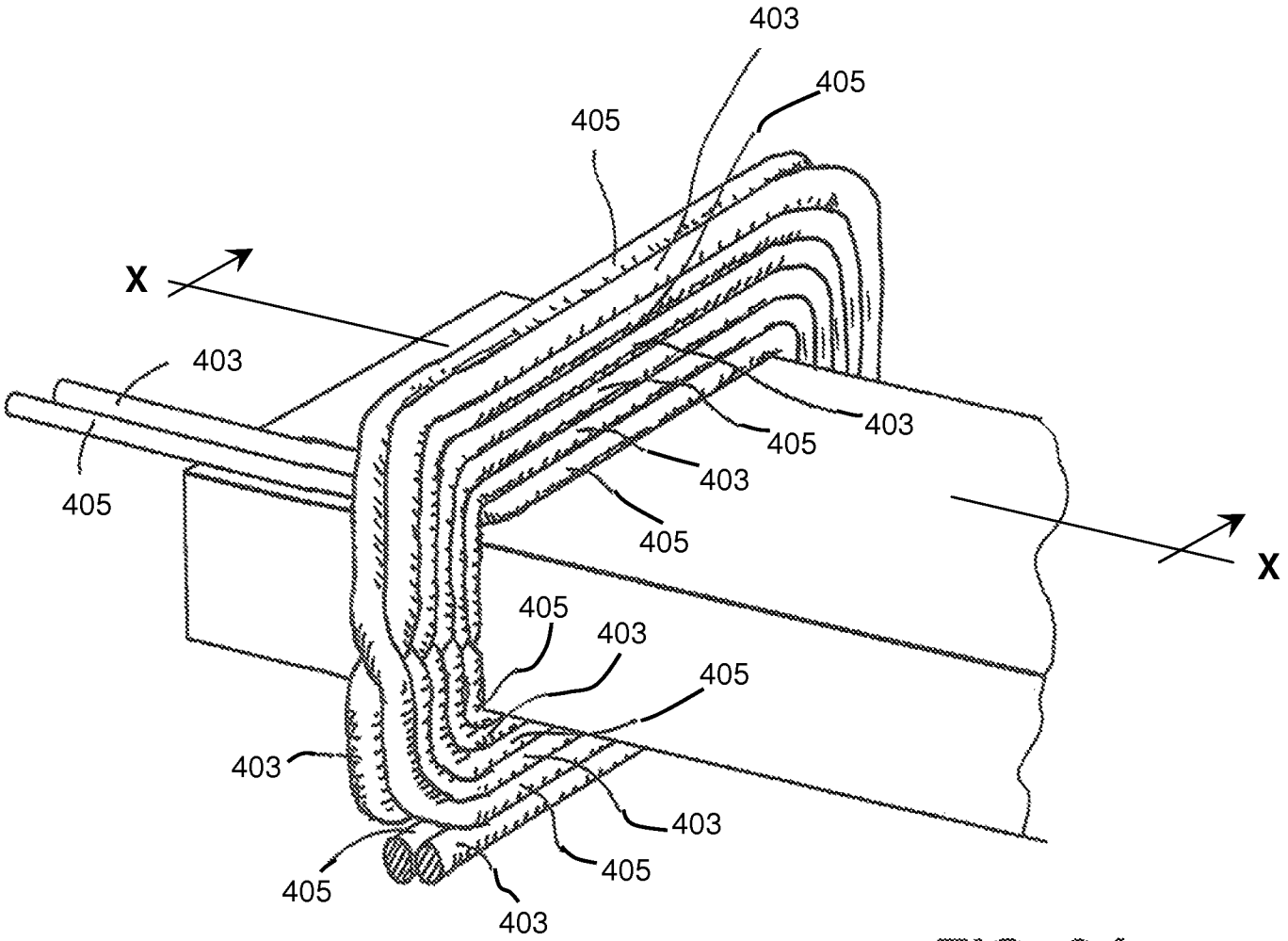
FIG. 24 is a view as in FIG. 23, wherein a number of additional circuits have been added to the underlying circuit shown in FIG. 23.

Referring to FIG. 24, this process is repeated several more times with a twist applied each time to the wires 403 and 405. The repeated application of the wires with a twist results in an alternating series of wires stacked each on top of one another. The result is a stacked or concentric series of loops in which the wires 403 and 405 alternate as seen in FIG. 25.

Figure 25:
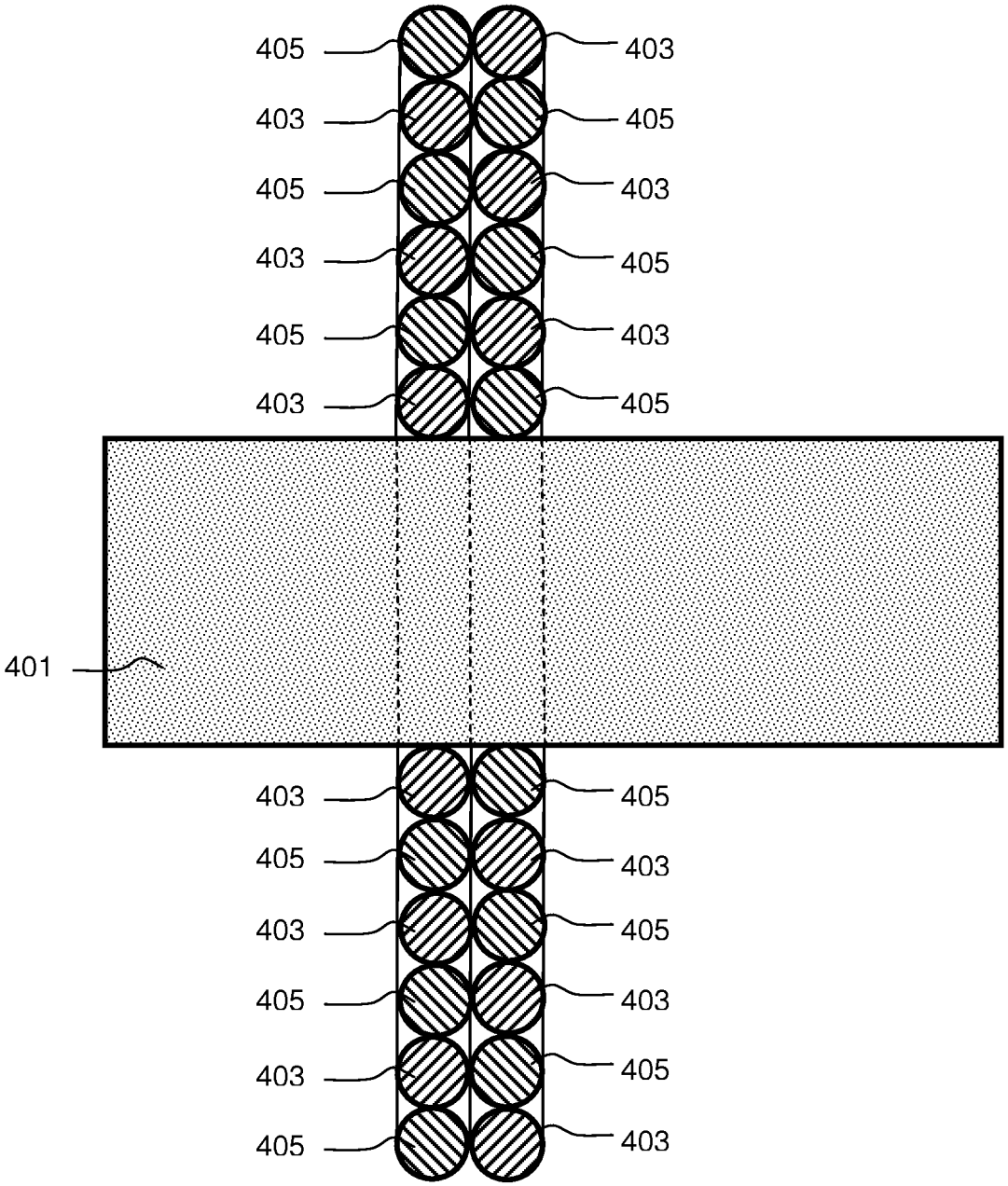
FIG. 25 is a view taken along line X-X of FIG. 24.

Referring to FIG. 25, it may be seen that the loop is made up of alternating wires 403 and 405 in a cross-section array of two columns by six rows. This arrangement has some basic advantages in terms of exchange of magnetic flux if wires 493 and 495 are connected to function, respectively, as primary and secondary circuits.

Figure 26:
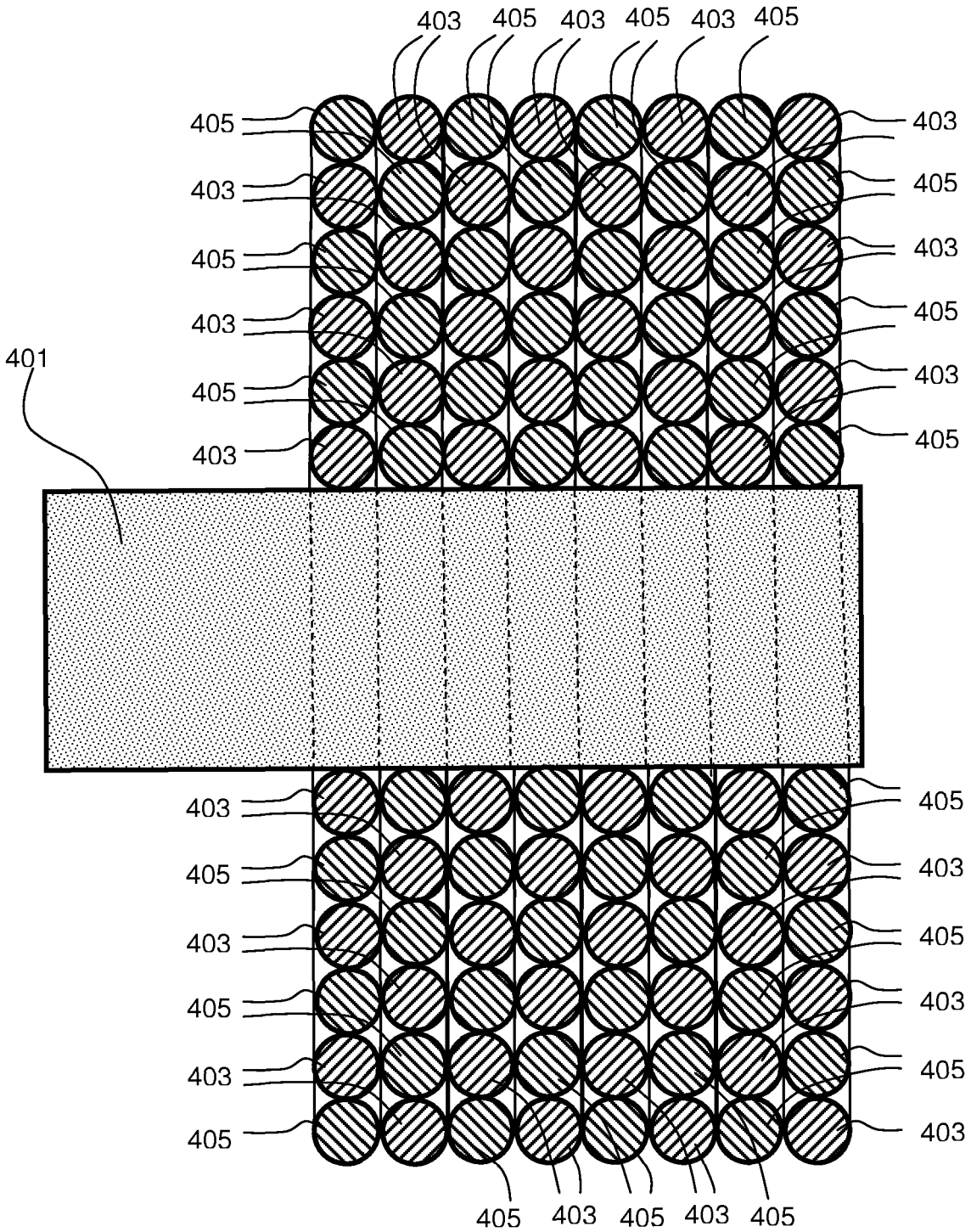
FIG. 26 is a view as in FIG. 25 with additional loops of wire applied alongside the first set of loops.

Referring to FIG. 26, additional loops such as that shown in FIG. 25 may be added adjacent the initial loop, with the qualification that the alternating arrangement should continue so that each of the wires shown in cross section has above and below it and to the left and right of it, in the same column or row, the other wire 405 or 403. In other words, the same loop in adjacent columns should be of the other wire of the system, so that each wire in cross section is surrounded by four wires of the other wire in the circuit.

At the other end of the circuits of the transformer the structure are two wires, which constitute the other side of the primary and secondary circuits, and wiring between the ends of wires 405 and the ends of wires 403 will create the relationship between the individual wires in the bundles therein and the relative changes in voltage from the primary to the secondary circuit during use of the transformer.

Figure 27:
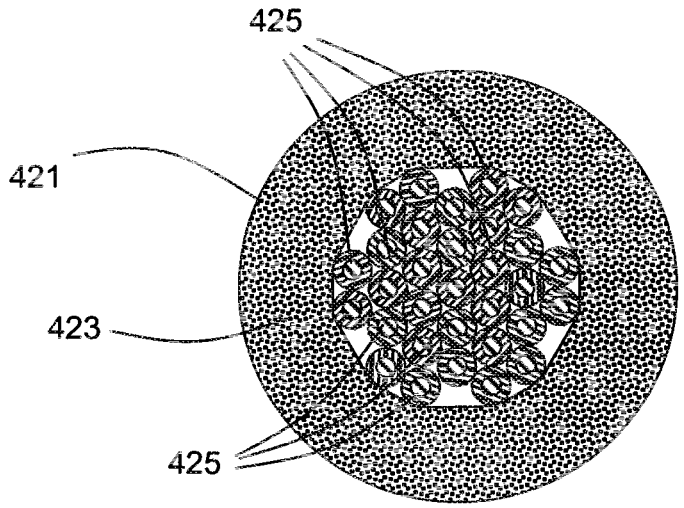
FIG. 27 is an exemplary detail cross section of a configuration of the wires of FIG. 26.

It will be understood here that the wires 403 and 405 may also be a multi-wire bundle as has been described previous, e.g., seven or more individually insulated wires wrapped in a bundle as shown in FIG. 20, or in the exemplary cross section of FIG. 27, which shows a wire bundle or cable 421 having a sheath 423 surrounding a number of individually insulated flexible wires 425. FIG. 27 has 21 wires as an example, although any number of wires may be in the bundle, or the sheath may encircle a single twisted conductor. The sheath 423 is made of flexible nonconductive material having some ferritic or magnetic qualities. The material may be, e.g., particles of iron or another magnetic material embedded in a flexible plastic material, or a nonconductive ferritic material, as has been discussed previously, if flexible enough for coiling the wire bundle.

Wire bundles similar to bundle 421 of FIG. 27 may be used to produce an embodiment of transformer according to the invention by another method of performing a winding, which is illustrated in FIGS. 28 to 31. Two wire bundles are employed in making this embodiment, and they are shown in white or gray in the diagrams. The full length of the wire bundles is not shown in all of the diagrams, but is cut away so as to show the progress of the winding as it is formed.

Figure 28:
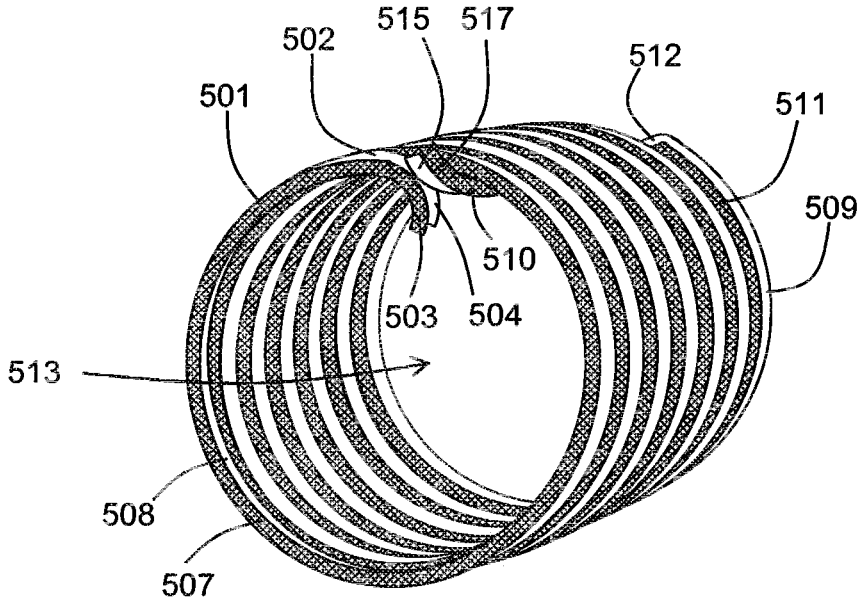
FIG. 28 is a partial perspective view of an initial part of an alternative embodiment of transformer wiring winding for making a transformer according to the invention.
Figure 29:
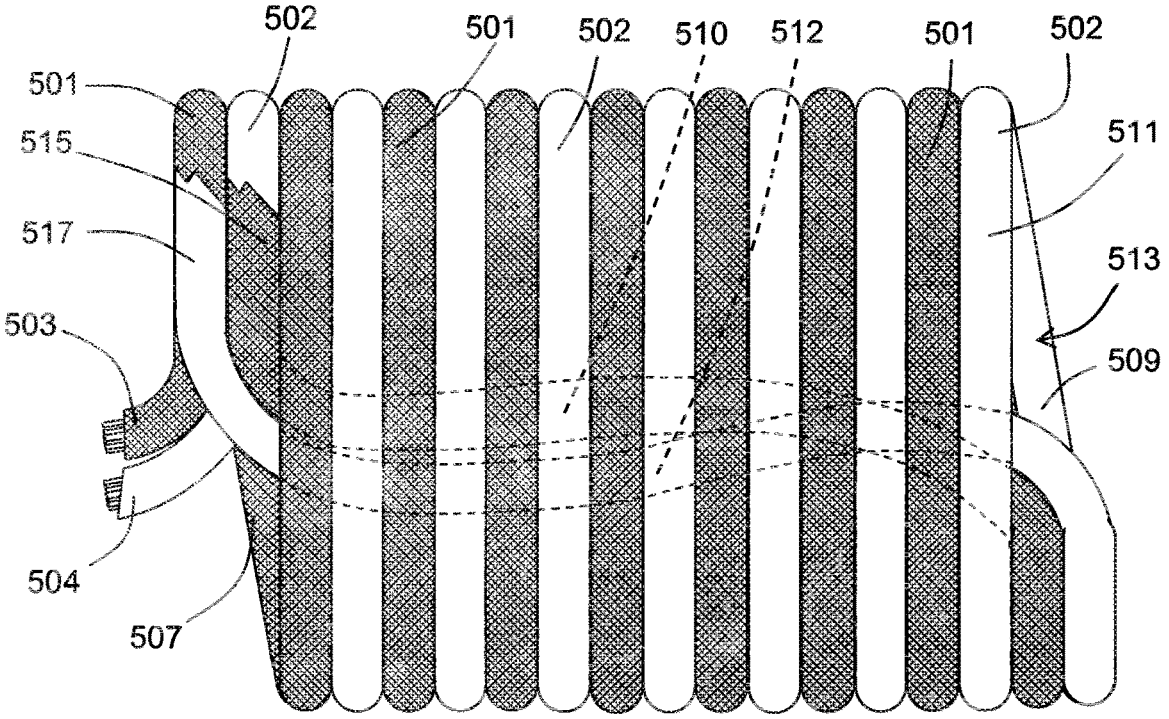
FIG. 29 is a side view of the winding of FIG. 28.

Referring to FIGS. 28 and 29, the winding is formed by winding two wire bundles 501 and 502 around a cylindrical starting support (not shown) so as to form a first cylindrical layer made of two interleaved spirals extending adjacent and interlaced with each other from initial wire ends 503 and 504 of wire bundles 501 and 502. The initial spiral loops 507 and 508 of the wire bundles 501, 502 are followed by several more spirals, which may be as many as are desired for the given application, up until the final spiral loops 509 and 511 of the two wires 501 and 502 at the end of the first layer.

Beyond the final spiral loops 509 and 511 of the wire bundles 501 and 502, each of the wire bundles 501, 502 has a respective returning portion 510, 512 shown in phantom in FIG. 29 that extends through interior space 513 in the middle of the spiral coils. These returning portions 519, 512 of the wire bundles 501 and 502 extend through the spirals of the first layer past the first loop 507.

Beyond the returning portions, the wire bundles 501, 502 are twisted and wrapped around the radially outward sides of the initial loop 507 of wire bundles 501 and 502 adjacent the connecting ends 503 and 504. These portions 515 and 517 of wire bundles 501 and 502 begin a second outward layer of spiral extending around the outer surface of the inner spiral shown in FIGS. 28 and 29. In this second layer, the wire bundles 501 and 502 are reversed so that the spiral of wire bundle 501 overlies the inward spiral wire bundle 502 radially outward thereof, and the spiral of wire bundle 502 overlies the spiral of wire bundle 501 radially outward thereof in the second layer of spiraling, which is shown in FIG. 30.

Figure 30:
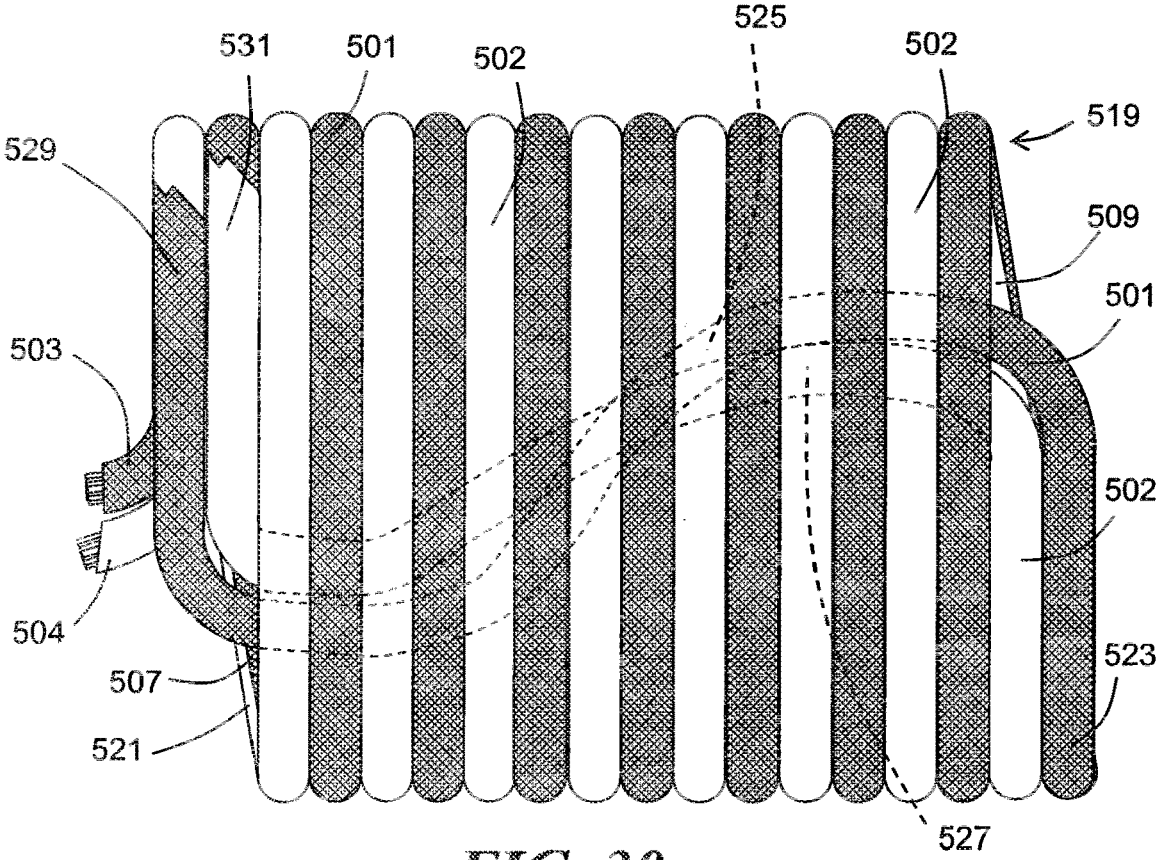
FIG. 30 is a view as in FIG. 29, but with an additional outer layer of winding thereon.

Referring to FIG. 30, a second layer generally indicated at 519 is applied over the outer surface of the first layer shown in FIG. 29, with wire bundles 501 and 502 again in interlaced spirals extending from a first outer layer loop 521 to a final outer layer loop 523 at the opposite end of the structure. The wire bundles 501 and 502 alternate as they extend around the outer surface of the structure. In the final loop 523, both of the wires 501 and 502 leave the outer surface of the spiral and have respective portions 525, 527 shown in phantom extending through the center passage 513 in the structure shown. These wire bundle portions 525 and 527 extend through the spiral anterior space 513 to the front end of the spiral assembly.

At the front end, the wire bundles are twisted and reversed again so that wire bundle 501 overlies wire bundle 502 with its third layer portion 529 and wire bundle 502 overlies wire bundle 501 with its third layer portion 531.

Figure 31:
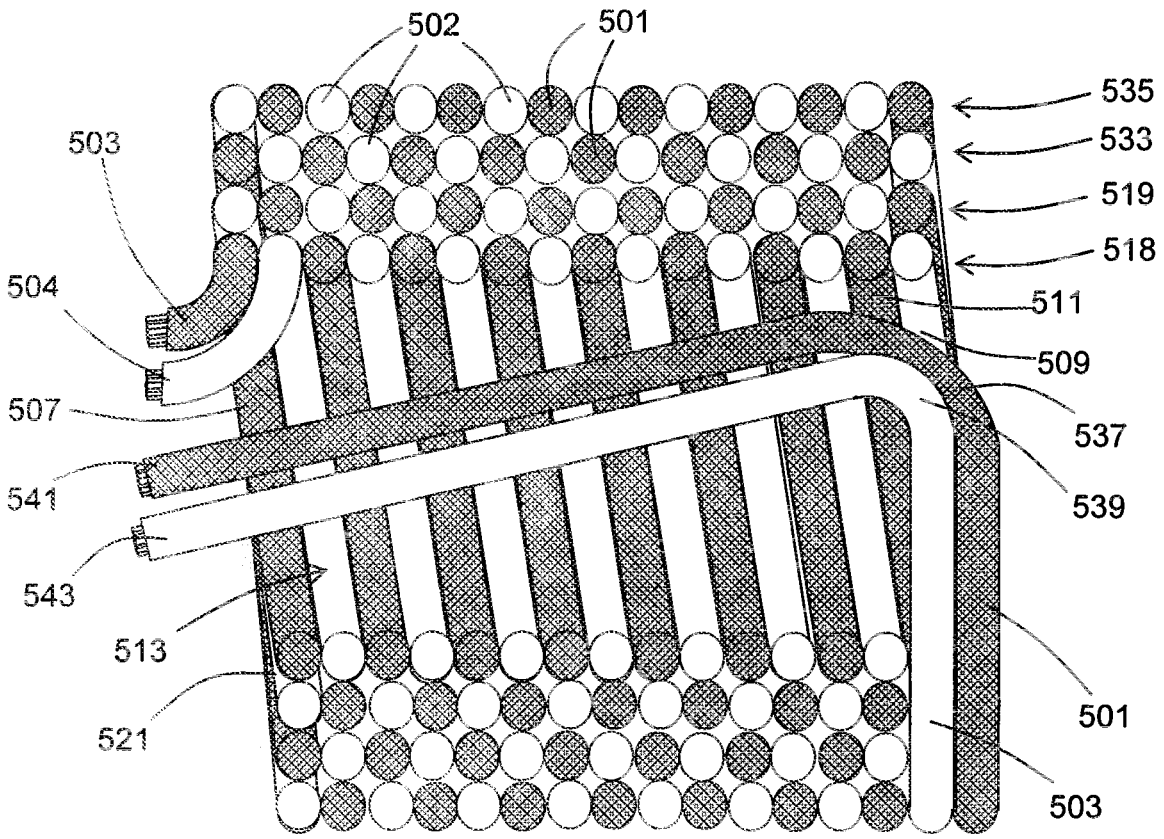
FIG. 31 is a partially cutaway cross sectional view through a vertical middle plane of the winding of FIGS. 28 to 31 with four layers of winding thereon.

This process of layering and reversing the order of the spirals is repeated as many times as is desired, resulting in a structure an example of which shown in FIG. 31. FIG. 31 shows a transformer structure having four layers with each spiral comprising eight individual loops of its respective wire bundle 501 or 502, applied in four separate layers 518, 519, 533 and 535. The final loops of wire bundle 501 and 502 in layer 535 includes respective portions 537 and 539 that extend through to the front or starting end of the structure, where these wire bundles have respective ends indicated generally at 541 and 543.

The individual wires in the ends of the bundles are connected so that one wire bundle 501 acts as the primary circuit and the wires of the other bundle 502 are connected so as to be the secondary circuit of the transformer.

In the arrangement shown, the individual wires in the wire bundles 501 and 502 extend electrically isolated from each other and in parallel between the ends 503 and 541 and between the ends 504 and 543 respectively.

To make the pathway of the circuit through the transformer as short as possible, the multiple wires in a given bundle may be connected in parallel to the power supply or the load, depending on whether it is the primary or secondary circuit, by connecting a respective branching structure, such as branching structure 279 in FIG. 19, to all the ends of the wires at each of the ends 503 and 541 or 504 and 543, and connecting the other ends of the branching structures to opposite sides of the power supply or the load.

Alternatively, some or all the wires in a bundle may be wired in series to produce an extended path of the circuit through the transformer by connecting one wire end in end part 503 or 504 to the power supply or the load, and connecting the end of a different wire at end 541 or 543 to the other side of the power supply or load. The ends of the other wires in the bundle are each connected with a respective end of another wire by connections crossing between ends 503 or 504 and 541 or 543, with the result that a spiral circuit extends repeatedly through the transformer, so that the current supplied to or created in the wires flows sequentially through the transformer through each of the wires, and then out to one side of the power supply or the load, the other side of which is connected with the wire leading to the first wire in the bundle.

Furthermore, a mixture of parallel and serial connections of the wires in the bundles may be used, so that the relative pathway lengths of the primary and secondary circuits can be selected as a variety of lengths between the maximum pathway length (all wires in the bundle connected in series) and the minimum pathway length (all wires in the bundle in parallel). By selecting appropriate lengths of the primary and secondary circuits in this way, it is possible to select the step-up or step-down change in the output voltage supplied from the transformer relative to the input voltage supplied to the transformer.

The pattern of the positions of the two wire bundles in cross section is similar to that of FIG. 2, wherein the cross sections of the wire bundles is a rectangular matrix, with the wire bundles of the primary circuit alternating in the rows and columns of the transformer with the wire bundles of the secondary circuit.

Figure 32:
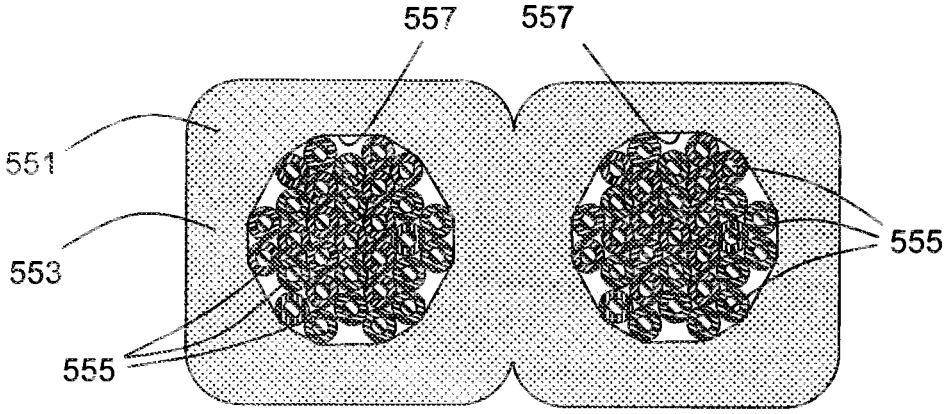
FIG. 32 is a cross-sectional detail view of a cable having two wire bundles therein that may be used in the embodiment of FIGS. 28 to 32.

According to the previous embodiment, the wire bundles may be separate bundle cables that are wrapped so as to be adjacent one another through the transformer. FIG. 32 shows a cross section of a double bundle cable 551 of wires that may be used to make a transformer similar to that shown in FIG. 31. Wire bundle cable 551 has a body 553 of flexible material with metallic particles, as described with respect to FIG. 27. The body 553 has two passages 557 extending through the length of the cable. The passages each have therein a respective set of mutually insulated electrical wires or cables 555. The transformer of FIG. 31 may be manufactured using the cable 551 in place of the two separate cables 501 and 502, with the cable being twisted every iteration of a level of the spiral so that the bundles of wires 555 of the primary circuit alternate with the bundles of wires of the secondary circuit.

Figure 33:
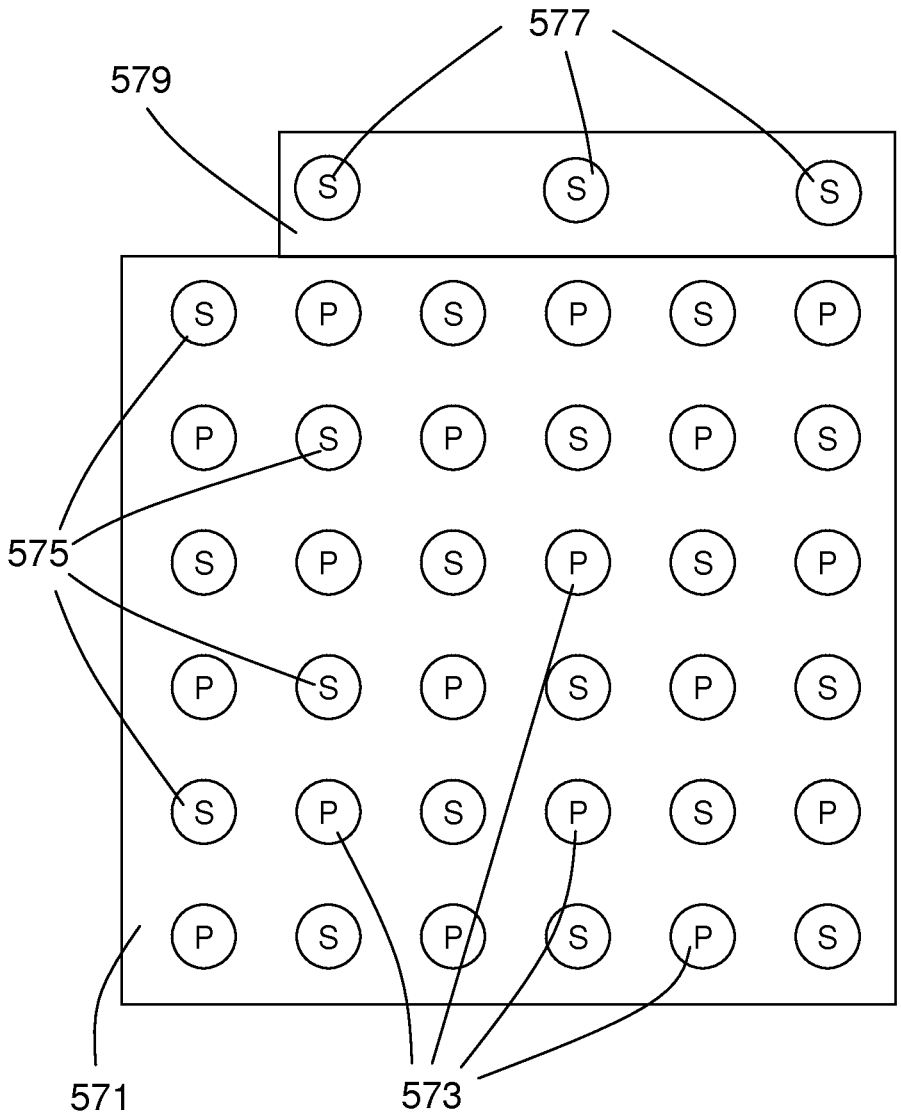
FIG. 33 is a cross-sectional diagram of a transformer according to the invention with an additional extension of the secondary coil applied on top thereof.

FIG. 33 shows a cross section of a transformer according to the invention wherein a rectangular matrix support 571 has passages therein that support primary coil wires 573 (all marked as P) and secondary coil wires 575 (all marked as S). The primary and secondary wires are bundled into to respective passages and the ends of them are wired so as to derive a desired output voltage based on the ratio $L_S/L_P$, as discussed above. The transformer experiences losses such that the output voltage is not quite as high as the input voltage multiplied by the ratio $L_S/L_P$. This may be offset by wiring an additional set of secondary coils 577 into the transformer in series with the other secondary coil wires S as an extension thereof after the secondary coil extends through the conduits of the matrix support 571. These additional secondary coils 577 each overly a respective primary coil conduit through the length of the matrix and are exposed to magnetic energy therefor as the other parts of the secondary coil 575 are. The additional secondary coils may be supported in a matrix support extension 579 of the same material as the matrix support 571.

It is not shown in FIG. 33, but an additional further length of secondary coil extensions may also be applied to the bottom side of the matrix support 571 as well, with those secondary-coil wires overlying respective primary coil conduits in the bottom row.

The terms used herein should be viewed as terms of description rather than limitation as those of ordinary skill in the art will be able with this specification before them will be able to make changes and modifications therein without departing from the spirit of the invention.

The term "parallel" as used herein is intended to have a broader meaning than the purely geometric definition, i.e., the relationship of two coplanar straight lines. Where two wire segments are straight, their being parallel means that they extend along two coplanar parallel lines, in the common geometrical usage. However, if wires segments extend in a curved path that is not a straight line, then, according to a more general understanding of the term, their being parallel means that the two wire segments extend next to each other, at a generally equal distance from each other over the pathway, as measured in a line that is normal to one wire segment. Wire segments that lie in arcs of mutually concentric circles would in this sense also be parallel.

Also, while the primary and secondary circuits of present specification may have loops that may be seen as analogous to the coils of a prior-art transformer, the term loops should be understood as a broadly descriptive, and not be confused with the coils of coaxial transformers, which are functionally different from the circuits of the present invention. Coaxial transformer coils generally function as electromagnets with high levels of magnetic field in the open center of the primary coil, which have a flux that is absorbed by the central loop area of the secondary coil. In the present invention, in contrast, to the extent that the loops of the primary and secondary circuits have a configuration with a center, the magnetic field therein is substantially less than in a coaxial transformer, and preferably minimal, due to the relative spatial placement of the wires of the primary and secondary coils.

What is claimed is:

1. An electrical transformer comprising:

a primary circuit extending between two ends, said primary circuit having at least one of the ends thereof connected with a power supply so that a first electrical current from the power source flows through the primary circuit;

a secondary circuit connected with an electrical load;

the primary and secondary circuits each having a respective plurality of wire segments having a length and being connected in series;

said wire segments of the primary and secondary circuits being supported so as to extend in pathways adjacent and parallel to each other over the length thereof in a cross-sectional pattern that is substantially constant over the length of the wire segments so that, when viewed in cross section perpendicular to the direction of extension thereof, the wire segments of the primary and secondary circuits are arranged with the wire segments of the primary circuit alternating with the wire segments of the secondary circuit around points in the cross-sectional pattern, and with the wire segments of the secondary circuit are separated spaced from each other and from the wire segments of the primary circuit; and wherein the first electrical current in the primary circuit causes formation of a second electrical current in the secondary circuit that is transmitted to the load;

wherein some of the wire segments of the secondary circuit each have a respective set of three or more of the wire segments of the primary circuit arranged rotatively spaced therearound at equal angles, and wherein the first electrical current creates varying magnetic fields about each of the wire segments of the primary circuit that magnetically induce the second electrical current flowing in said wire segments of the secondary circuit.

2. The electrical transformer of claim 1, wherein the wire segments are supported in the cross-sectional pattern over the length thereof by a wire support structure.

3. The electrical transformer of claim 2, wherein the cross sectional pattern is a matrix pattern of rows and columns, the pathways of the second circuit wire segments alternating with the pathways of the primary circuit in each of the rows and each of the columns, and wherein the respective sets each have four of the wire segments of the primary circuit arranged rotatively spaced therearound at angles of 90 degrees.

4. The electrical transformer of claim 2, wherein the cross-sectional pattern is a hexagonal pattern wherein three of the primary circuit wire segments and three of the secondary circuit wire segments are rotatively spaced at displacement angles of 60 degrees about the point, and wherein the respective sets each have no more than three of the wire segments of the primary circuit arranged rotatively spaced therearound at angles of 120 degrees.

5. The electrical transformer of claim 2, wherein a member of non-conductive iron-containing material is supported between the wire segments of the primary circuit and the wire segments of the secondary circuit.

6. The electrical transformer of claim 2, wherein the support structure comprises a body of non-conductive material having a number of passages therein, the wire segments being supported in bundles in said passages, each of said bundles of the primary circuit having at least two wire segments, the wire segments being covered in insulating material so as to be electrically isolated from each other.

7. The electrical transformer of claim 6, wherein each of said bundles of the primary circuit has at least seven wire segments therein covered in insulating material so as to be electrically isolated from each other.

8. The electrical transformer of claim 2, wherein the support structure is linear in shape.

9. The electrical transformer of claim 2, wherein the support structure has a plurality of parallel passages therein forming the pathways for the wire elements, and further passages therein providing for cooling of the transformer.

10. The electrical transformer of claim 9, wherein the support structure is formed of a plurality of modular components that include complementary mating parts that are assembled so as to form the parallel passages therebetween.

11. The electrical transformer of claim 1, wherein the wire segments of the primary circuit have a total length $L_p$ and the wire segments of the secondary circuit have a total length $L_s$, the second current having a voltage that differs from a voltage of the first current by a ratio of approximately $L_s/L_p$.

12. The electrical transformer of claim 1, wherein the wire segments are supported in bundles thereof in the pathways.

13. The electrical transformer of claim 1, wherein the primary or secondary circuit has a second plurality of wire segments connected in serial with each other and extending in at least some of the pathways, said first plurality of wire segments and said second plurality of wire segments being wired in parallel.

14. The electrical transformer of claim 1, wherein the wire support structure comprises a lattice structure of non-conducting ferritic material that surrounds each of the wire segments so that the wire segments each extend through a respective passage in the lattice structure over the length thereof.

15. The electrical transformer of claim 14, wherein in the lattice structure has coolant passages between the passages through which the wire segments extend, and a coolant gas or liquid is caused to flow through said coolant passages so as to cool the transformer.

16. The electrical transformer of claim 14, wherein the lattice structure is made up of a plurality of conductive elements of iron electrically isolated from each other.

17. The electrical transformer of claim 16, wherein the elements of iron have notches therein that define the cooling passages therebetween.

18. The electrical transformer of claim 1, wherein the transformer is formed by wrapping a pair of wires or wire bundles side by side around a base member a number of iterations so that the wires wrap around themselves each iteration, wherein the pair of wires are twisted each time the wires or bundles of wires extend around the base member so that one of the wires or wire bundles overlies the other of the wires or wire bundles on the next iteration of wrapping.

19. An electrical transformer comprising:

a support structure having a plurality of parallel passages therein arranged in a generally rectangular matrix of rows and columns, and supporting in each passage a respective bundle of mutually insulated wire segments all having two opposing ends and extending a length approximately equal to a length of the support structure;

said bundles constituting two subsets of bundles, the bundles of one of the subsets alternating with the bundles of the other subset in each row and column of the support structure, said bundles being separate from and spaced from each other;

a first of the wire segments in one of the bundles of the first subset of bundles being connected in series with a first group of wire segments, including a final wire segment thereof, wherein all of said wire segments are in the bundles of the first subset and form a primary circuit, a first of the wire segments in one of the bundles of the second subset of bundles being connected in series with a second group of wire segments, including a final wire segment thereof, and forming together a secondary circuit;

wherein all of said wire segments are connected such that current running through each of the wire segments of each of the groups of wire segments flows in one direction with respect to the support structure;

the first group of wire segments having a total length L thereof in the support structure from the end of the first wire to the end of the last wire segment thereof, and the second group of wire segments having a total length 1 thereof in the support structure from the end of the first wire to the end of the last wire segment thereof, a power supply connected with the first wire segment of the first group of wires so that an electrical current flows therethrough to the last wire segment thereof; and a load connected with the second group of wire segments so that electrical current created therein by the electrical current in the first group of wire segments flows thereto;

the electrical current flowing to the load having a voltage that is approximately 1/L times a voltage of the electrical current from the power source.

* * * * *